US007603073B2

(12) United States Patent
Kojima

(10) Patent No.: US 7,603,073 B2
(45) Date of Patent: Oct. 13, 2009

(54) IMAGE FORMING APPARATUS

(75) Inventor: Tomoyuki Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/896,830

(22) Filed: Sep. 6, 2007

(65) Prior Publication Data

US 2008/0075508 A1 Mar. 27, 2008

(30) Foreign Application Priority Data

Sep. 26, 2006 (JP) ..... 2006-261256

(51) Int. Cl.
*G03G 15/00* (2006.01)

(52) U.S. Cl. ..... 399/396; 399/394

(58) Field of Classification Search ..... 399/396, 399/394

See application file for complete search history.

(56) References Cited

U.S. PATENT DOCUMENTS 6,038,410 A * 3/2000 Iriyama ..... 399/51
6,501,930 B2 * 12/2002 Oku ..... 399/167
6,538,409 B2 * 3/2003 Takemoto ..... 318/560
7,197,256 B2 * 3/2007 Nishizaki ..... 399/66
2004/0131386 A1 * 7/2004 Koide ..... 399/167
2004/0165915 A1 * 8/2004 Hirai et al. ..... 399/302
2004/0190895 A1 * 9/2004 Iida et al. ..... 396/616

FOREIGN PATENT DOCUMENTS

JP 04-238376 8/1992
JP 11-327403 11/1999
JP 2005-134647 10/2003

* cited by examiner

*Primary Examiner*—Anthony H Nguyen
(74) *Attorney, Agent, or Firm*—Kubotera & Associates, LLC

(57) ABSTRACT

An image forming apparatus includes an image supporting member; a belt; a belt drive unit for rotating the belt; an acceleration and deceleration information storage unit; and a belt speed control unit. The belt speed control unit determines a difference between a first moving amount corresponding to rotations of the image supporting member from a stationary state thereof to a specific speed and a second moving amount corresponding to rotations of the belt from a stationary state thereof to the specific speed. The belt speed control unit controls the belt drive unit, so that a third moving amount corresponding to rotations of the belt from the specific speed to the stationary state thereof becomes larger than a fourth moving amount corresponding to rotations of the image supporting member from the specific speed to the stationary state thereof according to the difference.

17 Claims, 14 Drawing Sheets

IMAGE FORMING APPARATUS

BACKGROUND OF THE INVENTION

The present invention relates to an image forming apparatus such as a printer and a copier using an electro-photography method for forming an image on a recording medium.

In a conventional image forming apparatus, using toner in a plurality of colors, for example, four colors, toner images are formed on a photosensitive member corresponding to toner in a plurality of colors. Then, the toner images are sequentially transferred to a sheet or a recording medium.

In the conventional image forming apparatus, a belt transports the sheet to the photosensitive member, so that the toner images formed on the photosensitive member are transferred to the sheet. In this case, when the belt moves at a speed different from that of the photosensitive member, the toner images may be shifted with each other, i.e., color shift. To this end, there has been proposed another conventional image forming apparatus, in which a photosensitive member and a belt are controlled to move at a same speed.

In the conventional image forming apparatus, in which the photosensitive member and the belt are controlled to move at a same constant speed, until the photosensitive member is accelerated and reaches the constant speed, the photosensitive member needs to move for a distance longer than that of the belt until the belt reaches the same constant speed. Accordingly, the belt tends to receive excessive tension. As a result, when toner images are transferred to a sheet, the toner images tend to be shifted, thereby causing color shift.

In view of the problem described above, an object of the invention is to provide an image forming apparatus, in which it is possible to prevent a belt from receiving excessive tension when a photosensitive member is accelerated. Accordingly, it is possible to prevent toner images from being shifted when the toner images are transferred to a sheet, thereby preventing color shift.

Further objects and advantages of the invention will be apparent from the following description of the invention.

SUMMARY OF THE INVENTION

In order to attain the objects described above, according to a first aspect of the present invention, an image forming apparatus includes an image supporting member disposed to be rotatable and a belt facing the image supporting member and disposed to be rotatable. In the image forming apparatus, it is arranged so that the image supporting member and the belt move at a same speed upon forming an image.

Further, the image forming apparatus includes a belt drive unit for rotating the belt; an acceleration and deceleration information storage unit for storing acceleration and deceleration information to control acceleration and deceleration of the belt; and a belt speed control unit for controlling a speed of the belt driven with the belt drive unit according to the acceleration and deceleration information stored in the acceleration and deceleration information storage unit.

Further, the belt speed control unit determines a difference between a first moving amount and a second moving amount. The first moving amount corresponds to rotations of the image supporting member from a stationary state thereof to a specific speed. The second moving amount corresponds to rotations of the belt from a stationary state thereof to the specific speed. According to the difference between the first moving amount and the second moving amount, the belt speed control unit controls the belt drive unit, so that a third moving amount becomes larger than a fourth moving amount. The third moving amount corresponds to rotations of the belt from the specific speed to the stationary state thereof. The fourth moving amount corresponds to rotations of the image supporting member from the specific speed to the stationary state thereof.

In the first aspect of the present invention, as described above, the belt speed control unit determines the difference between the first moving amount corresponding to the rotations of the image supporting member from the stationary state thereof to the specific speed and the second moving amount corresponding to the rotations of the belt from the stationary state thereof to the specific speed. According to the difference between the first moving amount and the second moving amount, the belt speed control unit controls the belt drive unit, so that the third moving amount corresponding to the rotations of the belt from the specific speed to the stationary state thereof becomes larger than the fourth moving amount corresponding to the rotations of the image supporting member from the specific speed to the stationary state thereof.

Accordingly, when the image supporting member is accelerated, it is possible to prevent the belt from receiving excessive tension. As a result, it is possible to prevent toner images from being shifted when the toner images are transferred to a sheet, thereby preventing color shift.

DETAILED DESCRIPTION OF THE PREFERRED EMBODIMENTS

Hereunder, embodiments of the present invention will be explained with reference to the accompanying drawings.

First Embodiment

Figure 1:
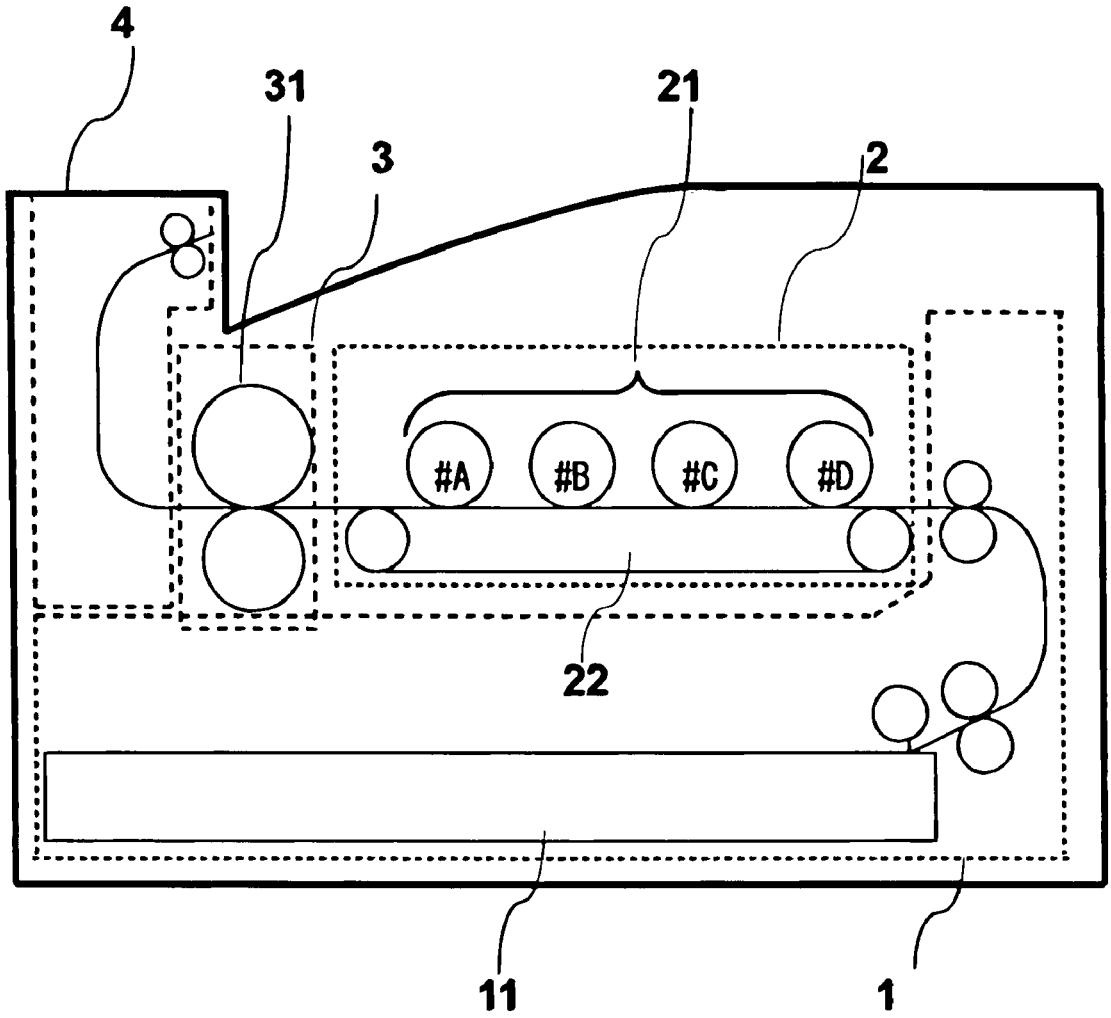
FIG. 1 is a schematic sectional view showing an image forming apparatus according to a first embodiment of the present invention.

A first embodiment of the present invention will be explained. FIG. 1 is a schematic sectional view showing an image forming apparatus according to the first embodiment of the present invention.

As shown in FIG. 1, the image forming apparatus includes a sheet supply unit 1 having a sheet storage unit 11 for storing a sheet; an image forming unit 2 having image supporting members 21 (#A to #D) for forming a static latent image and a belt 22 for transporting the sheet; a fixing unit 3 having a fixing roller 31; a sheet discharge unit 4; and an apparatus control system 5 (not shown in FIG. 1).

Figure 2:
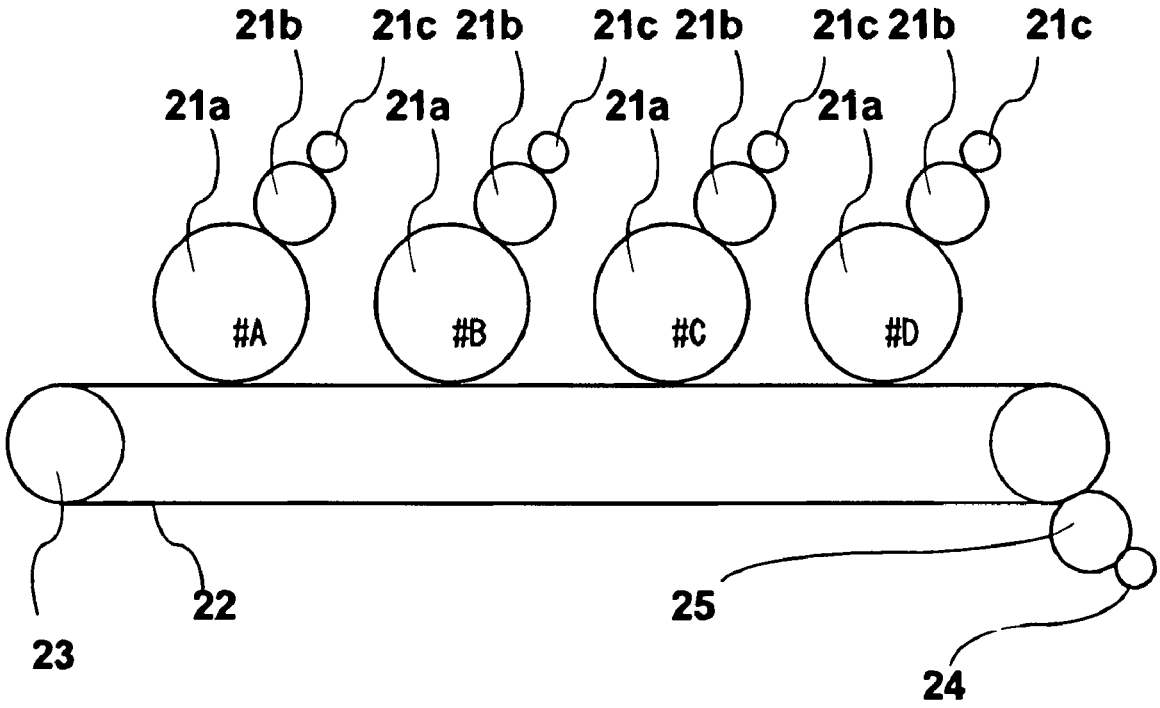
FIG. 2 is a schematic view showing an image forming unit disposed in the image forming apparatus according to the first embodiment of the present invention.

FIG. 2 is a schematic view showing the image forming unit 2 disposed in the image forming apparatus according to the first embodiment of the present invention. As shown in FIG. 2, the image forming unit 2 includes photosensitive drums 21*a* (#A to #D); photosensitive drum motors 21*c* (#A to #D) for driving the photosensitive drums 21*a* (#A to #D); and photosensitive drum drive transmission gears 21*b* (#A to #D) for reducing a rotational speed of the photosensitive drum motors 21*c* (#A to #D) and transmitting drive of the photosensitive drum motors 21*c* (#A to #D) to the photosensitive drums 21*a* (#A to #D).

In the embodiment, the image forming unit 2 further includes the belt 22 contacting with the photosensitive drums 21*a* (#A to #D) for transporting the sheet; a belt roller 23 for moving the belt 22; a belt motor 24 formed of a pulse motor for driving the belt roller 23; and a belt drive transmission gear 25 for reducing a rotational speed of the belt motor 24 and transmitting drive of the belt motor 24 to the belt roller 23.

Figure 3:
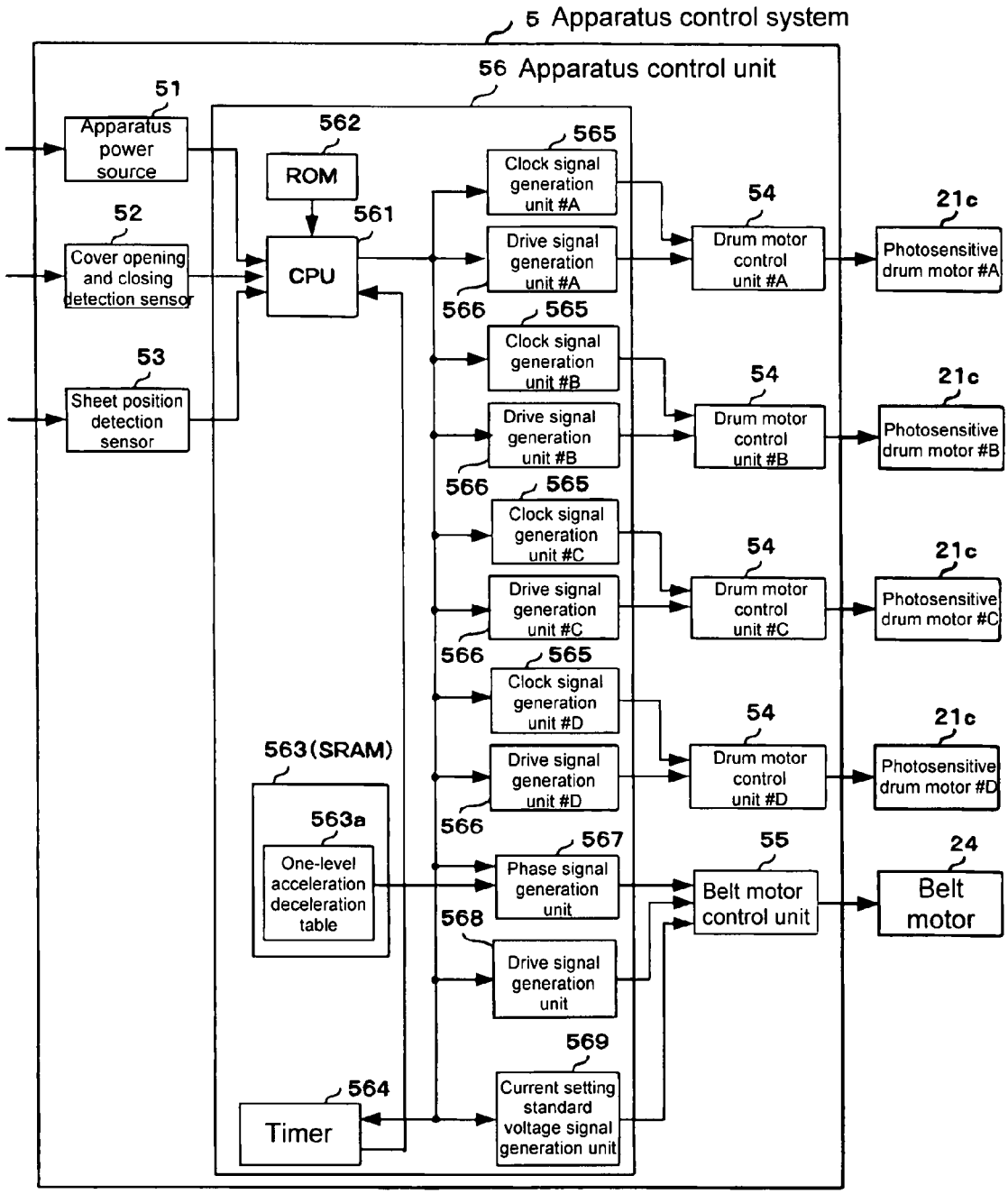
FIG. 3 is a block diagram showing an apparatus control system of the image forming apparatus according to the first embodiment of the present invention.

FIG. 3 is a block diagram showing the apparatus control system 5 of the image forming apparatus according to the first embodiment of the present invention. As shown in FIG. 3, the apparatus control system 5 includes an apparatus power source 51; a cover opening and closing detection sensor 52; a sheet position detection sensor 53; drum motor control units 54 (#A to #D); a belt motor control unit 55; and an apparatus control unit 56.

In the embodiment, the apparatus power source 51 rectifies and smoothes an alternative current voltage (AC voltage) to obtain a direct current voltage (DC voltage), so that the DC voltage is output to the apparatus control unit 56. The cover opening and closing detection sensor 52 detects an open state or a close state of an apparatus cover, and sends a signal indicating the open state or the close state to a central processing unit (CPU) 561 of the apparatus control unit 56. The sheet position detection sensor 53 is attached to a sheet transport path for sending a signal indicating existence of the sheet to the CPU 561.

In the embodiment, the drum motor control units 54 (#A to #D) include hole elements and encoders, so that the drum motor control units 54 (#A to #D) switch phases according to phases of the photosensitive drum motors 21*c* detected with the hole elements. Further, the drum motor control units 54 (#A to #D) adjust current duty of drive currents according to rotations of the photosensitive drum motors 21*c* detected with the encoders, so that a speed of the photosensitive drums 21*a* (#A to #D) becomes a speed A. Then, the drum motor control units 54 (#A to #D) output the drive currents to the photosensitive drum motors 21*c* (#A to #D). The phases include an acceleration state, a constant speed state, and a deceleration state.

In the embodiment, the belt motor control unit 55 includes a comparator for comparing an electric detection resistance for detecting a drive current of the belt motor 24 and a voltage converted by the electric detection resistance with a current setting standard voltage signal output from the apparatus control unit 56. The comparator compares the voltage converted by the electric detection resistance with the current setting standard voltage signal. When the voltage converted by the electric detection resistance is larger than the current setting standard voltage signal, constant current control is performed so that a voltage larger than a specific level is not applied to the belt motor 24.

In the embodiment, the apparatus control unit 56 includes the CPU 561; an ROM 562 for storing a control program; an SRAM 563; a timer 564 for measuring a time; clock signal generation units 565 (#A to #D); drive signal generation units 566 (#A to #D); a phase signal generation unit 567; a drive signal generation unit 568; and a current setting standard voltage signal generation unit 569.

In the embodiment, the CPU 561 executes the control program stored in the ROM 562 for performing an operation of the image forming apparatus (described later). The SRAM 563 stores a one-level acceleration deceleration table 563*a*.

Figure 4:
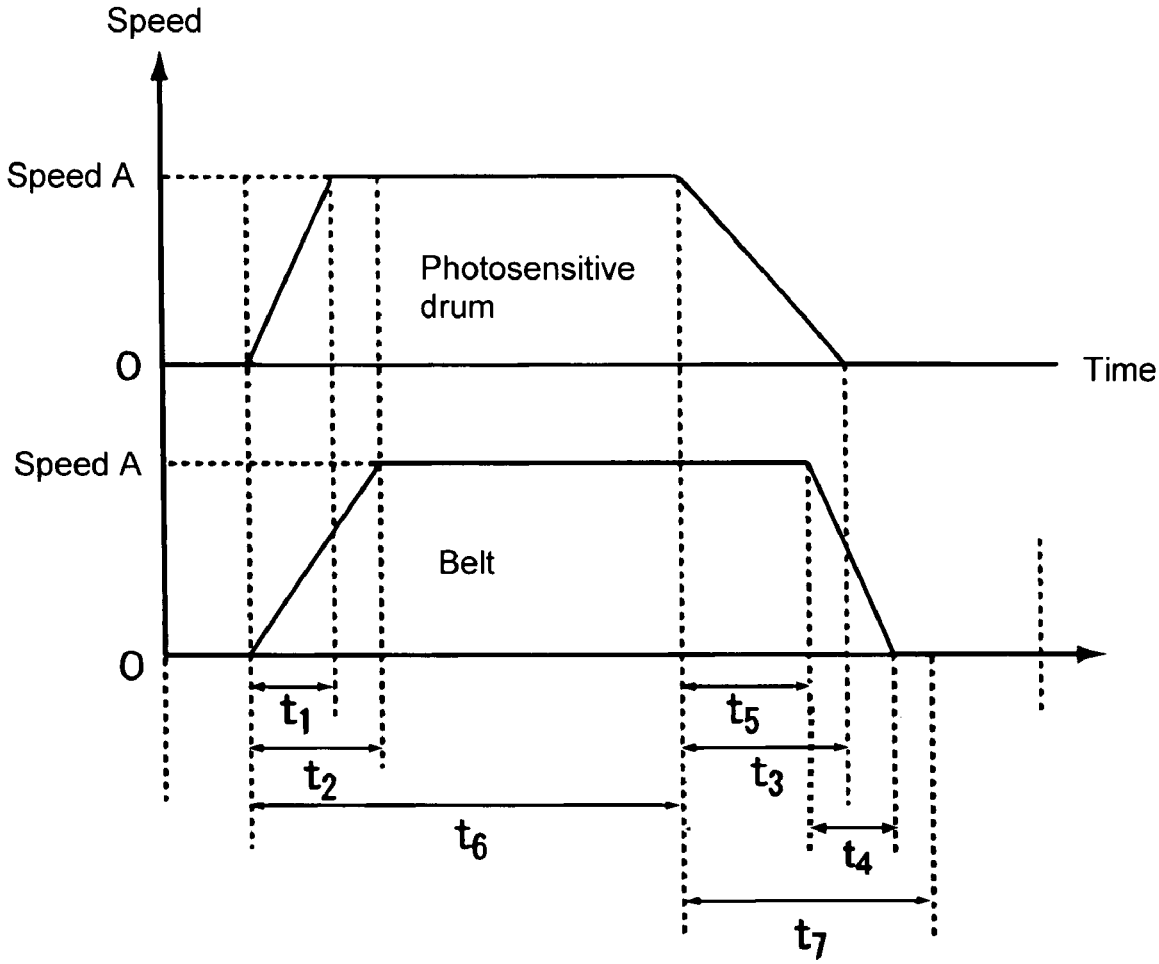
FIG. 4 is a graph showing a relationship between a speed and a time with respect to a photosensitive drum motor and a belt motor according to the first embodiment of the present invention.

FIG. 4 is a graph showing a relationship between a speed and a time with respect to the photosensitive drum motors 21*c* and the belt motor 24 according to the first embodiment of the present invention. The one-level acceleration deceleration table 563*a* stores acceleration information defining acceleration of the belt motor 24 following acceleration of the photosensitive drum motors 21*c*. The one-level acceleration deceleration table 563*a* further stores deceleration information defining deceleration of the belt motor 24 from a time $t_5$ shown in FIG. 4 after the photosensitive drum motor 21*c* starts decelerating. The phase signal generation unit 567 retrieves the acceleration information and the deceleration information.

In the embodiment, the clock signal generation units 565 (#A to #D) output clock signals to the drum motor control units 54 (#A to #D), so that the photosensitive drum motors 21*c* (#A to #D) drive the photosensitive drums 21*a* (#A to #D) to rotate at a target speed (speed A in FIG. 4).

In the embodiment, the drive signal generation units 566 (#A to #D) output drive signals (drum motor drive signals) to the drum motor control units 54 (#A to #D) to start the photosensitive drum motors 21*c* (#A to #D). Further, the drive signal generation units 566 (#A to #D) output the drum motor drive signals to the drum motor control units 54 (#A to #D) to stop the photosensitive drum motors 21*c* (#A to #D).

In the embodiment, the phase signal generation unit 567 outputs a phase signal to the belt motor control unit 55 according to the acceleration information and the deceleration information stored in the one-level acceleration deceleration table 563*a*. The phase signal is formed of a rectangular wave defining acceleration and deceleration of the belt motor 24.

In the embodiment, the drive signal generation unit 568 outputs a drive signal (belt motor drive signal) to the belt motor control unit 55 to start the belt motor 24, and outputs the belt motor drive signal to the belt motor control unit 55 to stop the belt motor 24. The current setting standard voltage signal generation unit 569 outputs a current setting standard voltage signal to the belt motor control unit 55, so that the comparator of the belt motor control unit 55 compares and determines whether the input voltage converted by the electric detection resistance is larger than a specific voltage defined in advance.

An operation of the image forming apparatus according to the embodiment will be explained next.

When the sheet supply unit 1 supplies the sheet stored in the sheet storage unit 11, the photosensitive drums 21*a* (#A to #D) and the belt motor 24 in the image forming unit 2 sandwich and transport the sheet. Then, exposure devices (not shown) expose the photosensitive drums 21*a* (#A to #D), so that the toner images are formed on the sheet. After the sheet with the toner images formed thereon is transported to the fixing unit 3, the fixing roller 31 in the fixing unit 3 heats the sheet, so that the toner images are fixed to the sheet. Afterward, the sheet discharge unit 4 discharges the sheet to an upper portion of the image forming apparatus, thereby completing a printing operation.

Figure 5:
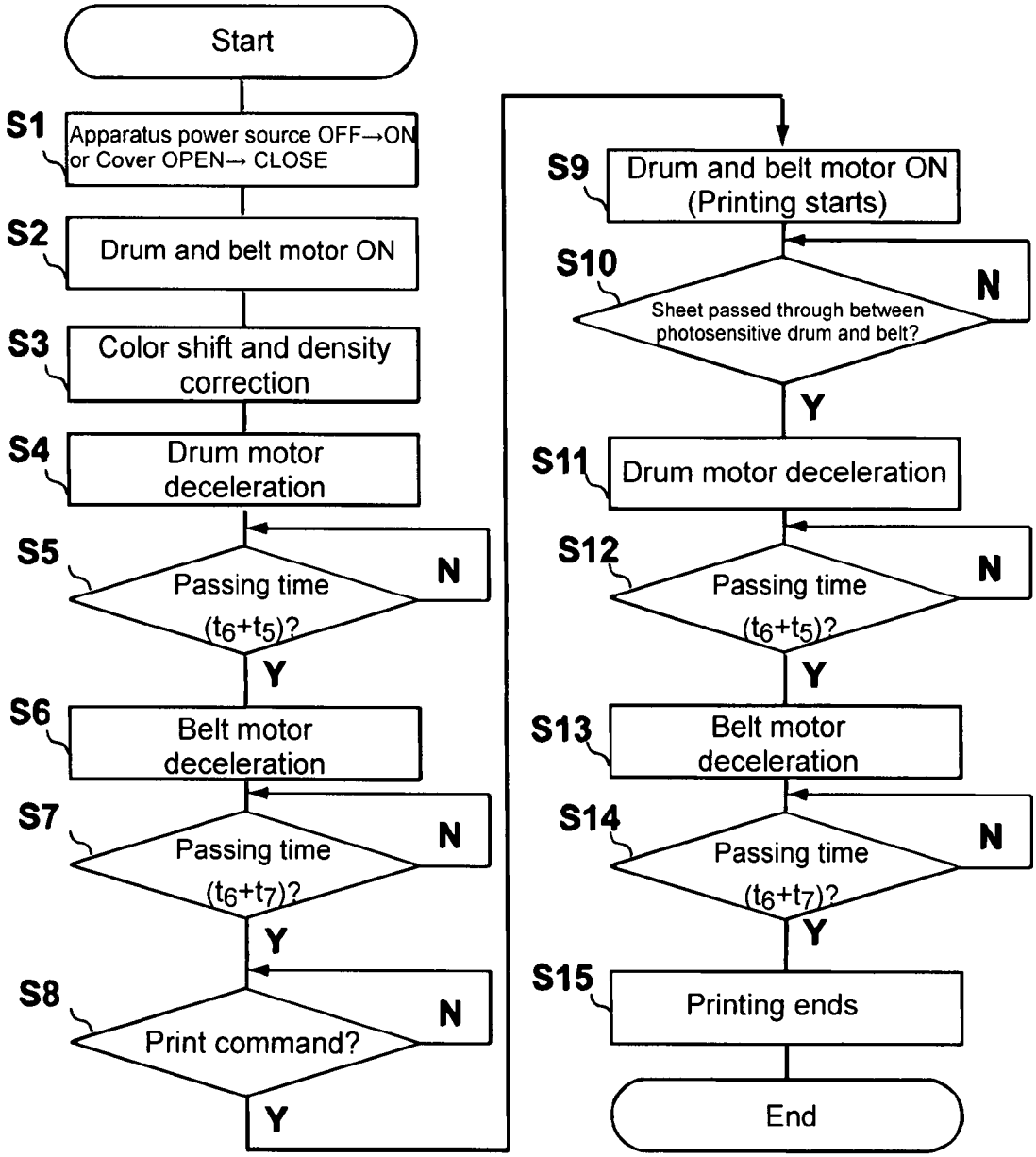
FIG. 5 is a flow chart showing an operation of the image forming apparatus according to the first embodiment of the present invention.

FIG. 5 is a flow chart showing the operation of the image forming apparatus according to the first embodiment of the present invention.

In step S1, when the image forming apparatus is turned on, the apparatus power source 51 rectifies and smoothes an AC voltage to obtain a DC voltage. When the DC voltage is output to the apparatus control unit 56, a signal is sent to the CPU 561 of the apparatus control unit 56. When the cover opening and closing detection sensor 52 sends a signal indicating the open state to the CPU 561, the CPU 561 sends OFF-ON signals indicating the DC voltage supplied from the apparatus power source 51 to the clock signal generation units 565 (#A to #D); the drive signal generation units 566 (#A to #D); the phase signal generation unit 567; the drive signal generation unit 568; the current setting standard voltage signal generation unit 569; and the timer 564.

Accordingly, the clock signal generation units 565 (#A to #D); the drive signal generation units 566 (#A to #D); the phase signal generation unit 567; the drive signal generation unit 568; the current setting standard voltage signal generation unit 569; and the timer 564 perform the following processes.

When the CPU 561 sends the OFF-ON signals, the clock signal generation units 565 (#A to #D) output the clock signals to the drum motor control units 54 (#A to #D), so that the photosensitive drums 21*a* (#A to #D) rotate at the speed A shown in FIG. 4 upon moving to the constant speed state.

When the CPU 561 sends the OFF-ON signals, the drive signal generation units 566 (#A to #D) output the drum motor drive signals having a signal level of "ON" to the drum motor control units 54 (#A to #D) to start the photosensitive drum motors 21*c* (#A to #D).

When the CPU 561 sends the OFF-ON signals, the phase signal generation unit 567 retrieves the acceleration information for accelerating the belt motor 24 from the one-level acceleration deceleration table 563*a*, and outputs the phase signal having a rectangular wave according to the acceleration information to the belt motor control unit 55, so that the belt motor 24 rotates constantly at the speed A at a time $t_2$ shown in FIG. 4.

When the CPU 561 sends the OFF-ON signals, the drive signal generation unit 568 outputs the belt motor drive signal having a signal level of "ON" to the belt motor control unit 55 to start the belt motor 24.

When the CPU 561 sends the OFF-ON signals, the current setting standard voltage signal generation unit 569 outputs the current setting standard voltage signal to the belt motor control unit 55, so that the comparator of the belt motor control unit 55 compares and determines whether the input voltage converted by the electric detection resistance is larger than a specific voltage defined in advance. Further, when the CPU 561 sends the OFF-ON signals, the timer 564 starts.

In step S2, when the drive signal generation units 566 (#A to #D) send the drum motor drive signals having the signal level of "ON" to the drum motor control units 54 (#A to #D), and the clock signal generation units 565 (#A to #D) send the clock signals to the drum motor control units 54 (#A to #D), the drum motor control units 54 (#A to #D) send start signals to the photosensitive drum motors 21*c* (#A to #D) to start (start rotating), so that the photosensitive drums 21*a* (#A to #D) rotate constantly at the speed A at a time $t_1$ shown in FIG. 4.

When the belt motor control unit 55 receives the belt motor drive signal having the signal level of "ON" from the drive signal generation unit 568 and the phase signal from the phase signal generation unit 567, the belt motor control unit 55 sends a start signal to the belt motor 24 to start (start rotating), so that the belt 22 rotates constantly at the speed A at the time $t_2$ shown in FIG. 4.

According to the start signals thus input, the photosensitive drum motors 21*c* (#A to #D) and the belt motor 24 gradually accelerate from a speed at zero, and rotate constantly at the speed A shown in FIG. 4.

In step S3, the CPU 561 sets information necessary for density correction and the likes in the image forming unit 2. When the timer 564 sends a signal indicating passing a time $t_6$ shown in FIG. 4, the CPU 561 sends signals to the drive signal generation units 566 (#A to #D), so that the drive signal generation units 566 (#A to #D) send the drum motor drive signals having a signal level of "OFF" to the drum motor control units 54 (#A to #D). Further, the CPU 561 sends signals to the clock signal generation units 565 (#A to #D), so that the clock signal generation units 565 (#A to #D) stop outputting the clock signals to the drum motor control units 54 (#A to #D).

Upon receiving the signals from the CPU 561, the drive signal generation units 566 (#A to #D) send the drum motor drive signals having the signal level of "OFF" to the drum motor control units 54 (#A to #D). Further, upon receiving the signals from the CPU 561, the clock signal generation units 565 (#A to #D) stop outputting the clock signals to the drum motor control units 54 (#A to #D).

In step S4, when the drum motor control units 54 (#A to #D) receive the drum motor drive signals having the signal level of "OFF" from the drive signal generation units 566 (#A to #D), and the clock signal generation units 565 (#A to #D) stop outputting the clock signals to the drum motor control units 54 (#A to #D), the drum motor control units 54 (#A to #D) stop the photosensitive drum motors 21*c* (#A to #D). Accordingly, as shown in FIG. 4, the photosensitive drum motors 21*c* (#A to #D) gradually decelerate, and stop at a time $(t_6+t_3)$.

In step S5, while the photosensitive drum motors 21*c* (#A to #D) gradually decelerate, the CPU 561 determines whether the timer 564 sends a signal indicating passing a time $(t_6+t_5)$ from the start.

When it is determined that the timer 564 does not send the signal indicating passing the time $(t_6+t_5)$, the CPU 561 waits until the timer 564 sends the signal indicating passing the time $(t_6+t_5)$. When it is determined that the timer 564 sends the signal indicating passing the time $(t_6+t_5)$, the CPU 561 sends a signal to the drive signal generation unit 568, so that the drive signal generation unit 568 sends the belt motor drive signal having the signal level of "OFF" to the belt motor control unit 55 to stop the belt motor 24. Further, the CPU 561 sends a signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the deceleration information for decelerating the belt motor 24 from the one-level acceleration deceleration table 563*a* in the SRAM 563, and sends the phase signal having the rectangular wave according to the deceleration information to the belt motor control unit 55, so that the belt motor 24 decelerates from the constant speed state at the speed A at the time $t_2$ to a speed of zero at a time $(t_6+t_5+t_4)$ shown in FIG. 4.

In step S6, when the belt motor control unit 55 receives the belt motor drive signal having the signal level of "OFF" from the drive signal generation unit 568 and the phase signal having the rectangular wave according to the deceleration information from the phase signal generation unit 567, the belt motor control unit 55 stops the belt motor 24. Accordingly, as shown in FIG. 4, the belt motor 24 gradually decelerates from the speed A and stops at the time $(t_6+t_5+t_4)$.

In step S7, the CPU 561 determines whether the timer 564 sends a signal indicating passing a time $(t_6+t_7)$ from the start. It is set such that a time $t_7$ is longer than the time $(t_5+t_4)$ at which the belt motor 24 stops. Accordingly, even if a print command is input and the belt motor 24 starts again during deceleration of the belt motor 24, it is possible to stably accelerate the belt motor 24.

When the CPU 561 determines that the timer 564 does not send the signal indicating passing the time $(t_6+t_7)$ from the start, the CPU 561 waits until the timer 564 sends the signal indicating passing the time $(t_6+t_7)$.

In step S8, when the CPU 561 determines that the timer 564 sends the signal indicating passing the time $(t_6+t_7)$ from the start, the CPU 561 determines whether the print command is input through an operation unit (not shown). When the CPU 561 determines that the print command is not input, the process becomes idle until the print command is input.

In step S9, when the CPU 561 determines that the print command is input, the CPU 561 sends signals to the clock signal generation units 565 (#A to #D); the drive signal generation units 566 (#A to #D); the phase signal generation unit 567; the drive signal generation unit 568; the current setting standard voltage signal generation unit 569; and the timer 564. Accordingly, the clock signal generation units 565 (#A to #D); the drive signal generation units 566 (#A to #D); the phase signal generation unit 567; the drive signal generation unit 568; the current setting standard voltage signal generation unit 569; and the timer 564 perform processes similar to step S2, respectively.

In step S10, the CPU 561 determines whether the sheet position detection sensor 53 sends a sheet detection signal indicating that the sheet passes through between the photosensitive drum 21*a* (#A) and the belt 22. When it is determined that the CPU 561 does not receive the sheet detection signal, the CPU 561 waits until the CPU 561 receives the sheet detection signal. When it is determined that the CPU 561 receives the sheet detection signal, the CPU 561 waits until the timer 564 sends a signal indicating passing the time $t_6$.

When the CPU 561 receives the signal indicating passing the time $t_6$ from the timer 564, the CPU 561 sends the signals to the drive signal generation units 566 (#A to #D), so that the drive signal generation units 566 (#A to #D) send the drum motor drive signals having the signal level of "OFF" to the drum motor control units 54 (#A to #D). Further, the CPU 561 sends the signals to the clock signal generation units 565 (#A to #D), so that the clock signal generation units 565 (#A to #D) stop outputting the clock signals to the drum motor control units 54 (#A to #D).

Upon receiving the signals from the CPU 561, the drive signal generation units 566 (#A to #D) send the drum motor drive signals having the signal level of "OFF" to the drum motor control units 54 (#A to #D). Further, upon receiving the signals from the CPU 561, the clock signal generation units 565 (#A to #D) stop outputting the clock signals to the drum motor control units 54 (#A to #D).

In step S11, when the drum motor control units 54 (#A to #D) receive the drum motor drive signals having the signal level of "OFF" from the drive signal generation units 566 (#A to #D), and the clock signal generation units 565 (#A to #D) stop outputting the clock signals to the drum motor control units 54 (#A to #D), the drum motor control units 54 (#A to #D) stop the photosensitive drum motors 21*c* (#A to #D). Accordingly, as shown in FIG. 4, the photosensitive drum motors 21*c* (#A to #D) gradually decelerate, and stop at the time $(t_6+t_3)$.

In step S12, while the photosensitive drum motors 21*c* (#A to #D) gradually decelerate, the CPU 561 determines whether the timer 564 sends the signal indicating passing the time $(t_6+t_5)$ from the start.

When it is determined that the timer 564 does not send the signal indicating passing the time $(t_6+t_5)$, the CPU 561 waits until the timer 564 sends the signal indicating passing the time $(t_6+t_5)$. When it is determined that the timer 564 sends the signal indicating passing the time $(t_6+t_5)$, the CPU 561 sends the signal to the drive signal generation unit 568, so that the drive signal generation unit 568 sends the belt motor drive signal having the signal level of "OFF" to the belt motor control unit 55 to stop the belt motor 24. Further, the CPU 561 sends the signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the deceleration information for decelerating the belt motor 24 from the one-level acceleration deceleration table 563*a* in the SRAM 563, and sends the phase signal having the rectangular wave according to the deceleration information to the belt motor control unit 55, so that the belt motor 24 decelerates from the constant speed state at the speed A at the time $(t_6+t_5)$ to the speed of zero at the time $(t_6+t_5+t_4)$ shown in FIG. 4.

In step S13, when the belt motor control unit 55 receives the belt motor drive signal having the signal level of "OFF" from the drive signal generation unit 568 and the phase signal having the rectangular wave according to the deceleration information from the phase signal generation unit 567, the belt motor control unit 55 stops the belt motor 24. Accordingly, as shown in FIG. 4, the belt motor 24 gradually decelerates from the speed A and stops at the time $(t_6+t_5+t_4)$.

In step S14, after the belt motor 24 starts decelerating, the CPU 561 determines whether the timer 564 sends the signal indicating passing the time $(t_6+t_7)$ from the start. When the CPU 561 determines that the timer 564 does not send the signal indicating passing the time $(t_6+t_7)$ from the start, the CPU 561 waits until the timer 564 sends the signal indicating passing the time $(t_6+t_7)$.

In step S15, when the CPU 561 determines that the timer 564 sends the signal indicating passing the time ($t_6+t_7$) from the start, the CPU 561 determines that the printing operation is completed. Accordingly, the CPU 561 sends a signal to the current setting standard voltage signal generation unit 569, so that the current setting standard voltage signal generation unit 569 stops sending the current setting standard voltage signal. Upon receiving the signal from the CPU 561, the current setting standard voltage signal generation unit 569 stops sending the current setting standard voltage signal, thereby completing the printing operation.

A method of determining the time $t_5$ measured by the timer 564 will be explained with reference to FIG. 4. In order to determine the time $t_5$, it is necessary to determine the following parameters: a difference in moving amounts or rotations between the photosensitive drum motors 21*c* (#A to #D) and the belt motor 24 during the acceleration; a difference in moving amounts or rotations between the photosensitive drum motors 21*c* (#A to #D) and the belt motor 24 during the deceleration; and a moving amount G (mm).

The moving amount G (mm) is a sum of a moving mount of the belt motor 24 due to a play of the belt drive transmission gear 25 disposed between the belt motor 24 and the belt roller 23, and a moving amount of the belt motor 24 due to transmission delay associated with deformation in a case that the belt drive transmission gear 25 is connected with a gear formed of a metal material and another gear formed of a non-metal material having a low rigidity.

As shown in FIG. 4, the photosensitive drum motors 21*c* (#A to #D) accelerate during the time $t_1$ (acceleration time $t_1$), and the belt motor 24 accelerates during the time $t_2$ (acceleration time $t_2$). Further, the photosensitive drum motors 21*c* and the belt motor 24 rotate at the speed A (mm/s) after the acceleration. Accordingly, the difference in the moving amounts between the photosensitive drum motors 21*c* (#A to #D) and the belt motor 24 during the acceleration is expressed by $A(t_2-t_1)/2$ (mm). In this case, an acceleration rate is assumed to be constant.

Similarly, the photosensitive drum motors 21*c* (#A to #D) decelerate during the time $t_3$ (deceleration time $t_3$), and the belt motor 24 decelerates during the time $t_4$ (deceleration time $t_4$). Further, the photosensitive drum motors 21*c* and the belt motor 24 rotate at the speed A (mm/s) before the deceleration. Accordingly, the difference in the moving amounts between the photosensitive drum motors 21*c* (#A to #D) and the belt motor 24 during the deceleration is expressed by $A(t_3-t_4)/2$ (mm). In this case, a deceleration rate is assumed to be constant.

The moving amount G (mm) may be determined empirically and experimentally based on a type of image forming apparatus, a use year, and the likes.

As described above, the difference in the moving amounts between the photosensitive drum motors 21*c* (#A to #D) and the belt motor 24 during the acceleration is expressed by $A(t_2-t_1)/2$ (mm); the difference in the moving amounts between the photosensitive drum motors 21*c* (#A to #D) and the belt motor 24 during the deceleration is expressed by $A(t_3-t_4)/2$ (mm); and the moving amount G (mm) is determined empirically and experimentally. Accordingly, the sum of these parameters is expressed by $(A(t_2-t_1)/2+A(t_3-t_4)/2+G)$. Therefore, the time $t_5$ is calculated by dividing the sum by A, and is obtained as follows:

$$t_5=(t_2-t_1)/2+(t_3-t_4)/2+t_8$$

In the equation, $t_1$ is the drum motor acceleration time; $t_2$ is the belt motor acceleration time; $t_3$ is the drum motor deceleration time; $t_4$ is the belt motor deceleration time; and $t_8$ (=G/A) is the drive transmission delay time due to the play and the deformation of the gear.

For example, when $t_1$=200 ms; $t_2$=300 ms; $t_3$=200 ms; $t_4$=100 ms; A=100 mm/s=$100\times10^{-3}$ mm/ms; and G=2.0 mm, the time $t_5$ is determined to be 120 ms. In this case, the time $t_6$ may be 5300 ms, and the time $t_7$ may be 620 ms.

In determining the time $t_5$, there may be a case that the belt motor 24 rotates while the photosensitive drum motors 21*c* (#A to #D) stop. In this case, the belt motor 24 slides against the photosensitive drum motors 21*c* (#A to #D), so that drum films formed on the photosensitive drum motors 21*c* (#A to #D) may wear, thereby making it difficult to perform the printing operation normally.

Figure 6:
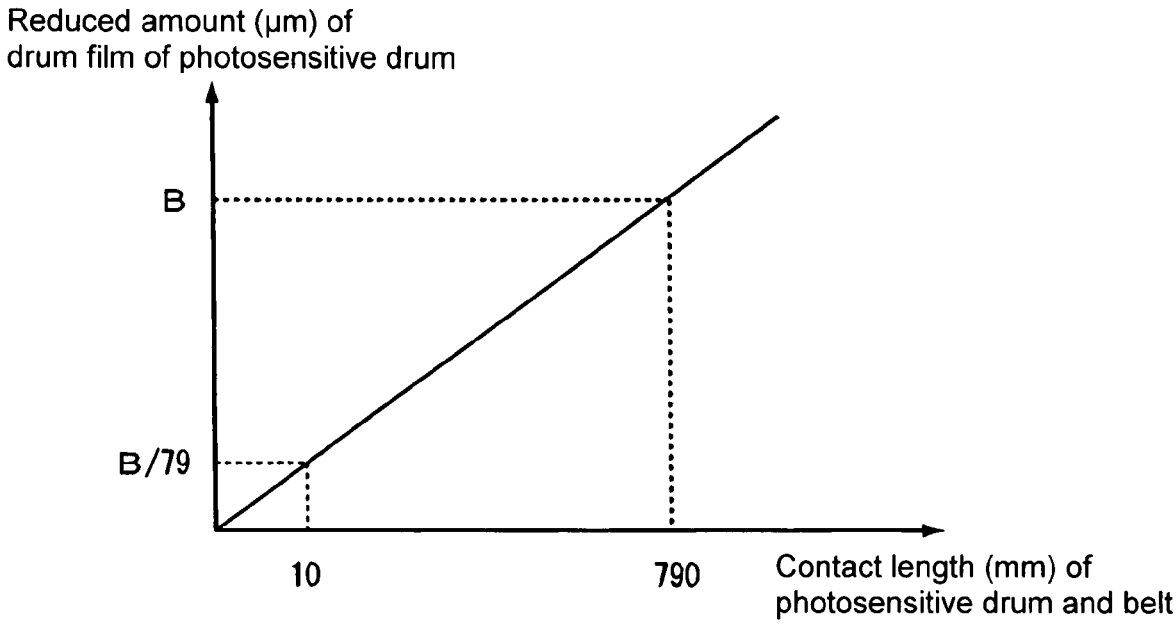
FIG. 6 is a graph showing a relationship between a contact length of a photosensitive drum and a belt and a reduced amount of a drum film of the photosensitive drum according to the first embodiment of the present invention.

A reduced amount (μm) of the drum film will be explained next. FIG. 6 is a graph showing a relationship between a contact length (mm) of the photosensitive drum 21*a* and the belt 22 and a reduced amount (μm) of the drum film of the photosensitive drum 21*a* according to the first embodiment of the present invention. In FIG. 6, the horizontal axis represents the contact length (mm) of the photosensitive drum 21*a* and the belt 22, and the vertical axis represents the reduced amount (μm) of the drum film of the photosensitive drum 21*a*.

As shown in FIG. 6, a reduced amount B represents a limit of the drum film at the end of lifetime of the photosensitive drum 21*a*. When the time $t_5$ is determined to be 120 ms, the contact length of the photosensitive drum 21*a* and the belt 22 is 10 mm, and the reduced amount of the drum film of the photosensitive drum 21*a* is B/79 μm. Accordingly, it is apparent that the image forming apparatus still has a sufficient lifetime even the time $t_5$ is set at 120 ms.

In the embodiment, the belt motor control unit 55 controls the drum motor control units 54 (#A to #D) to decelerate according to the one-level acceleration deceleration table 563*a* in the SRAM 563, so that the moving amount of the belt 22 during the deceleration from the speed A to the speed zero becomes larger than the moving amount of the photosensitive drums 21*a* (#A to #D) during the deceleration. Accordingly, it is possible to prevent the belt 22 from receiving excessive tension. As a result, it is possible to prevent the toner images from being shifted when the toner images are transferred to the sheet, thereby preventing color shift.

Second Embodiment

A second embodiment of the present invention will be explained next. An image forming apparatus in the second embodiment has a configuration similar to that in the first embodiment shown in FIGS. 1 to 3. Accordingly, components in the second embodiment similar to those in the first embodiment are designated with the same reference numerals, and explanations thereof are omitted.

Similar to the first embodiment, in the second embodiment, as shown in FIG. 1, the image forming apparatus includes the sheet supply unit 1 having the sheet storage unit 11 for storing the sheet; the image forming unit 2 having the image supporting members 21 (#A to #D) for forming the static latent image and the belt 22 for transporting the sheet; the fixing unit 3 having the fixing roller 31; the sheet discharge unit 4; and the apparatus control system 5 (not shown in FIG. 1).

Figure 7:
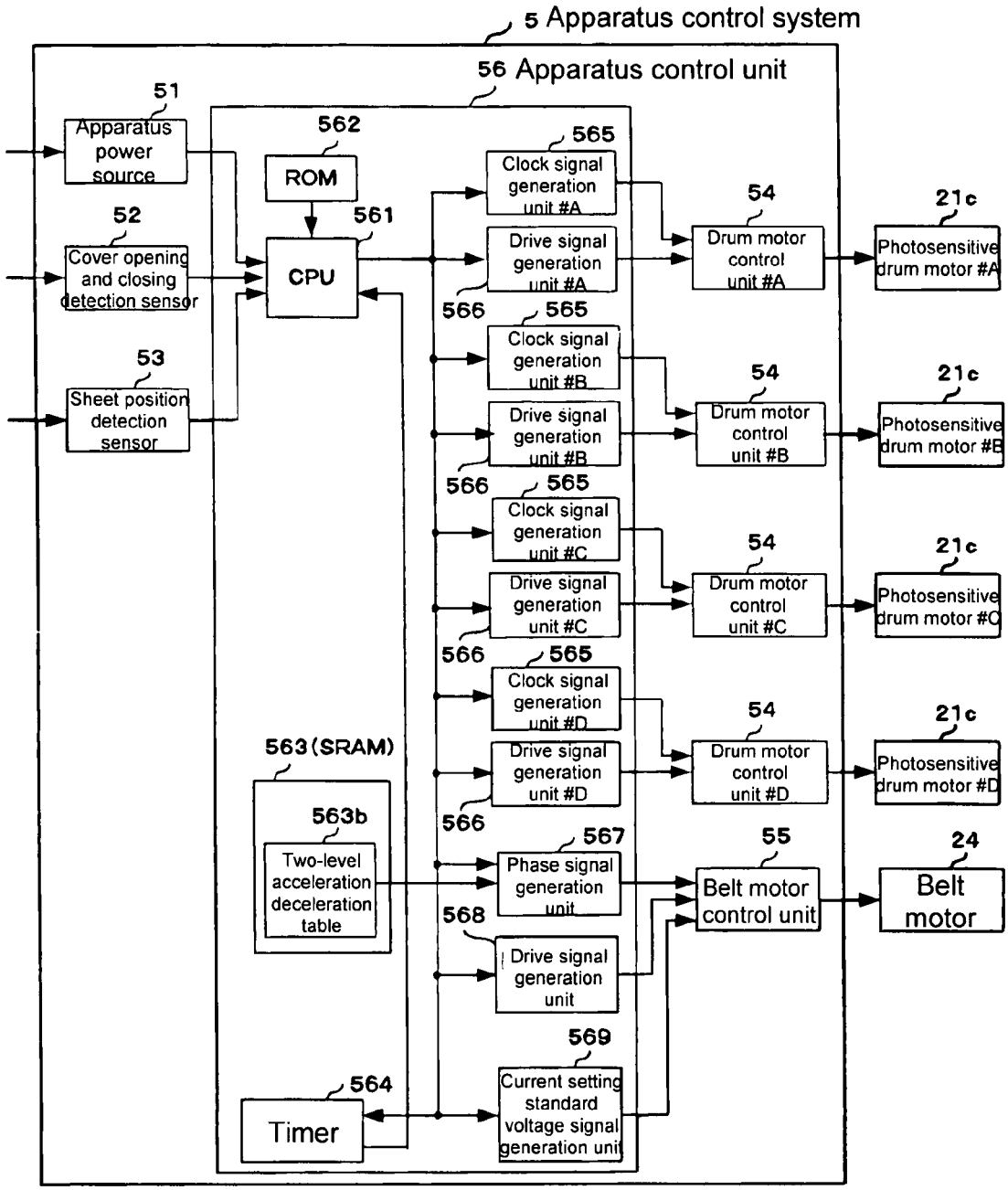
FIG. 7 is a block diagram showing an apparatus control system of an image forming apparatus according to a second embodiment of the present invention.

FIG. 7 is a block diagram showing the apparatus control system 5 of the image forming apparatus according to the second embodiment of the present invention. As shown in FIG. 7, the apparatus control system 5 includes the apparatus power source 51; the cover opening and closing detection sensor 52; the sheet position detection sensor 53; the drum motor control units 54 (#A to #D); the belt motor control unit 55; and the apparatus control unit 56. The apparatus power source 51; the cover opening and closing detection sensor 52; the sheet position detection sensor 53; the drum motor control units 54 (#A to #D); and the belt motor control unit 55 have configurations same as those in the first embodiment, and explanations thereof are omitted.

In the embodiment, the apparatus control unit 56 includes the CPU 561; the ROM 562 for storing a control program; the SRAM 563; the timer 564 for measuring a time; the clock signal generation units 565 (#A to #D); the drive signal generation units 566 (#A to #D); the phase signal generation unit 567; the drive signal generation unit 568; and the current setting standard voltage signal generation unit 569. The clock signal generation units 565 (#A to #D); the drive signal generation units 566 (#A to #D); the drive signal generation unit 568; and the current setting standard voltage signal generation unit 569 have configurations same as those in the first embodiment, and explanations thereof are omitted.

As shown in FIG. 7, in the second embodiment, instead of the one-level acceleration deceleration table 563*a* in the first embodiment, the SRAM 563 stores a two-level acceleration deceleration table 563*b*.

Figure 8:
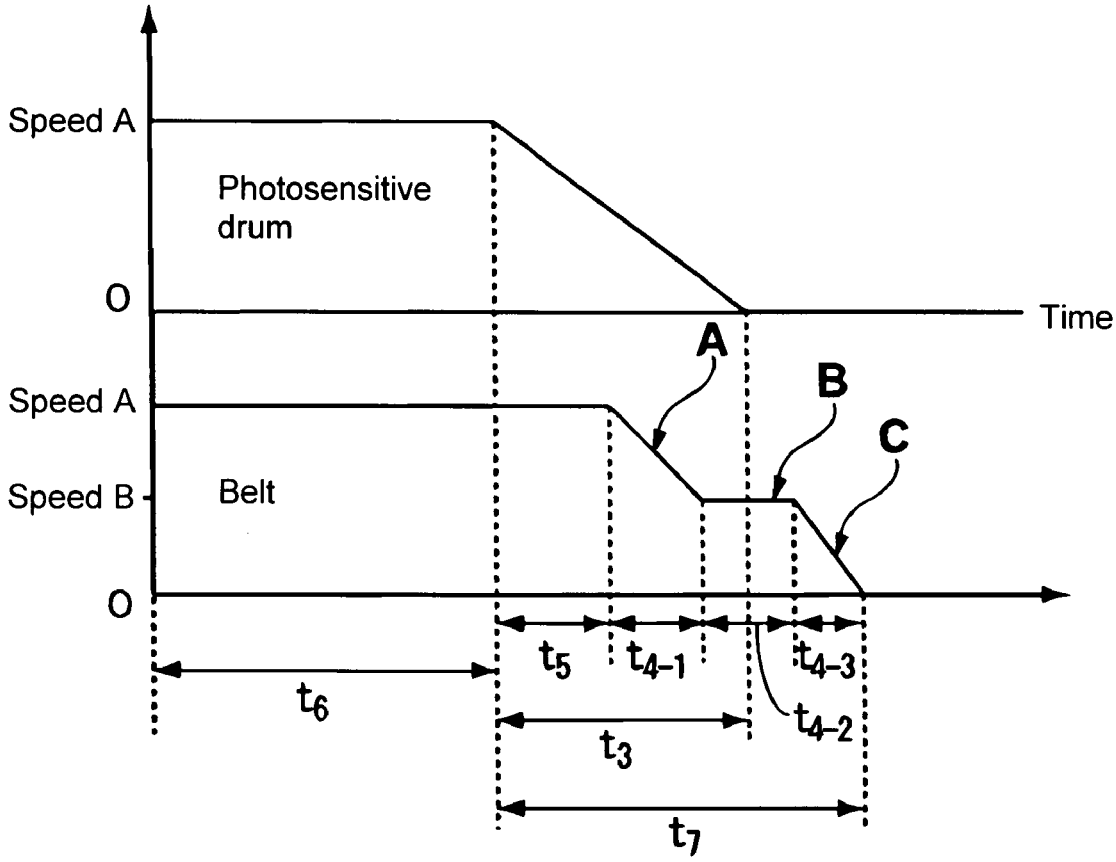
FIG. 8 is a graph showing a relationship between a speed and a time with respect to a photosensitive drum motor and a belt motor according to the second embodiment of the present invention.

FIG. 8 is a graph showing a relationship between a speed and a time with respect to the photosensitive drum motor 21*c* and the belt motor 24 according to the second embodiment of the present invention. The two-level acceleration deceleration table 563*b* contains first step deceleration information for a first deceleration phase A shown in FIG. 8; second constant speed information for a second constant speed phase B shown in FIG. 8; and second step deceleration information for a second deceleration phase C shown in FIG. 8.

In the embodiment, the first step deceleration information indicates that the belt 22 moving at the speed A starts deceleration at a time ($t_6+t_5$) and moves at a speed B at a time ($t_6+t_5+t_{4-1}$). The second constant speed information indicates that the belt 22 moves at the speed B constantly from the time ($t_6+t_5+t_{4-1}$) to a time ($t_6+t_5+t_{4-1}+t_{4-2}$). The second step deceleration information indicates that the belt 22 moving at the speed B starts deceleration at a time ($t_6+t_5+t_{4-1}+t_{4-2}$) and stops at a time ($t_6+t_5+t_{4-1}+t_{4-2}+t_{4-3}$).

In the embodiment, the timer 564 measures an elapsed time, and sends a signal to the CPU 561 each time when it passes the time ($t_6+t_5$), the time ($t_6+t_5+t_{4-1}$), the time ($t_6+t_5+t_{4-1}+t_{4-2}$), and the time ($t_6+t_5+t_{4-1}+t_{4-2}+t_{4-3}$) (=time ($t_6+t_7$)). Further, the phase signal generation unit 567 sends the phase signal to the belt motor control unit 55 according to the two-level acceleration deceleration table 563*b* in the SRAM 563.

Figure 9:
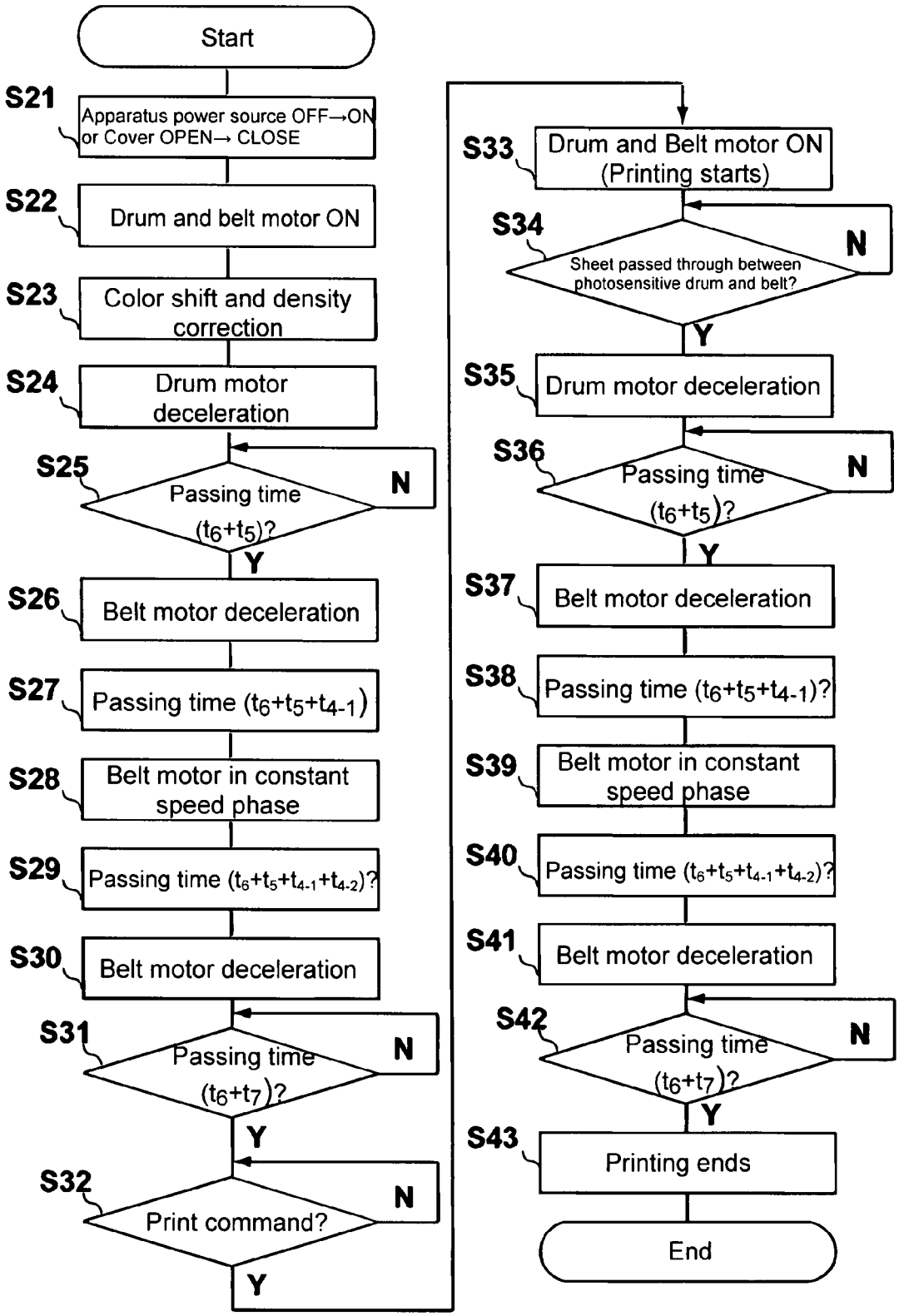
FIG. 9 is a flow chart showing an operation of the image forming apparatus according to the second embodiment of the present invention.

An operation of the image forming apparatus according to the embodiment will be explained next. FIG. 9 is a flow chart showing the operation of the image forming apparatus according to the second embodiment of the present invention.

In the second embodiment, a process from step S21, in which the apparatus power source 51 rectifies and smoothes an AC voltage to obtain a DC voltage to be output to the apparatus control unit 56, to step S25, in which it is determined whether it passes the time ($t_6+t_5$), is similar to that from step S1 to step S5 shone in FIG. 5 in the first embodiment.

When it is determined that the timer 564 sends the signal indicating passing the time ($t_6+t_5$), the CPU 561 sends a signal to the drive signal generation unit 568, so that drive signal generation unit 568 sends the belt motor drive signal having the signal level of "OFF" to the belt motor control unit 55 to stop the belt motor 24. Further, the CPU 561 sends the signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the first step deceleration information for decelerating the belt motor 24 from the two-level acceleration deceleration table 563*b* in the SRAM 563, and sends the phase signal having a rectangular wave according to the first step deceleration information to the belt motor control unit 55.

In step S26, when the belt motor control unit 55 receives the belt motor drive signal having the signal level of "OFF" from the drive signal generation unit 568 and the phase signal from the phase signal generation unit 567, the belt motor control unit 55 controls the belt motor 24 to decelerate the belt 22 to the speed B at the time ($t_6+t_5+t_{4-1}$). Accordingly, the belt motor 24 gradually decelerates from the speed A, and the belt 22 moves constantly at the speed B at the time ($t_6+t_5+t_{4-1}$).

In step S27, when the CPU 561 determines that the timer 564 sends the signal indicating passing the time ($t_6+t_5+t_{4-1}$) from the start, the CPU 561 sends the signal to the drive signal generation unit 568, so that the drive signal generation unit 568 sends the belt motor drive signal having the signal level of "ON" to the belt motor control unit 55 to start the belt motor 24. Further, the CPU 561 sends the signal to the phase signal generation unit 567, so that the phase signal generation unit 567 stops sending the phase signal to the belt motor control unit 55.

In step S28, upon receiving the signal from the CPU 561, the drive signal generation unit 568 sends the belt motor drive signal having the signal level of "ON" to the belt motor control unit 55. Similarly, upon receiving the signal from the CPU 561, the phase signal generation unit 567 stops sending the phase signal to the belt motor control unit 55. Accordingly, the belt motor 24 moves the belt 22 at the speed B in the second constant speed phase shown in FIG. 8.

In step S29, when it is determined that the timer 564 sends the signal indicating passing the time ($t_6+t_5+t_{4-1}+t_{4-2}$), the CPU 561 sends a signal to the drive signal generation unit 568, so that the drive signal generation unit 568 sends the belt motor drive signal having the signal level of "OFF" to the belt motor control unit 55 to stop the belt motor 24. Further, the CPU 561 sends the signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the second step deceleration information for decelerating the belt motor 24 from the two-level acceleration deceleration table 563*b* in the SRAM 563, and sends the phase signal having a rectangular wave according to the second step deceleration information to the belt motor control unit 55 to decelerate the belt motor 24.

In step S30, the belt 24 gradually decelerates and stops at the time ($t_6+t_5+t_{4-1}+t_{4-2}+t_{4-3}$). Accordingly, the belt 22 gradually slows down from the second constant speed phase at the speed B shown in FIG. 8, becomes the speed zero at the time ($t_6+t_5+t_{4-1}+t_{4-2}+t_{4-3}$).

A process from step S31, in which the CPU 561 determines whether the timer 564 sends a signal indicating passing the time ($t_6+t_7$) from the start, to step S36, in which the CPU 561 determines whether the timer 564 sends the signal indicating passing the time ($t_6+t_5$) from the start, is similar to the process from step S7 to step S12 in the first embodiment.

When it is determined that the timer 564 sends the signal indicating passing the time ($t_6+t_5$) in step S36, the CPU 561 sends the signal to the drive signal generation unit 568, so that the drive signal generation unit 568 sends the belt motor drive signal having the signal level of "OFF" to the belt motor control unit 55 to stop the belt motor 24. Further, the CPU 561 sends the signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the first step deceleration information for decelerating the belt motor 24 from the two-level acceleration deceleration table 563*b* in the SRAM 563, and sends the phase signal having a rectangular wave according to the first step deceleration information to the belt motor control unit 55

In step S37, when the belt motor control unit 55 receives the belt motor drive signal having the signal level of "OFF" from the drive signal generation unit 568 and the phase signal from the phase signal generation unit 567, the belt motor control unit 55 controls the belt motor 24 to decelerate the belt 22 to the speed B at the time ($t_6+t_5+t_{4-1}$). Accordingly, the belt motor 24 gradually decelerates from the speed A, and the belt 22 moves constantly at the speed B at the time ($t_6+t_5+t_{4-1}$).

In step S38, when the CPU 561 determines that the timer 564 sends the signal indicating passing the time ($t_6+t_5+t_{4-1}$) from the start, the CPU 561 sends the signal to the drive signal generation unit 568, so that the drive signal generation unit 568 sends the belt motor drive signal having the signal level of "ON" to the belt motor control unit 55 to start the belt motor 24. Further, the CPU 561 sends the signal to the phase signal generation unit 567, so that the phase signal generation unit 567 stops sending the phase signal to the belt motor control unit 55.

In step S39, upon receiving the signal from the CPU 561, the drive signal generation unit 568 sends the belt motor drive signal having the signal level of "ON" to the belt motor control unit 55. Similarly, upon receiving the signal from the CPU 561, the phase signal generation unit 567 stops sending the phase signal to the belt motor control unit 55. Accordingly, the belt motor 24 moves the belt 22 at the speed B in the second constant speed phase shown in FIG. 8.

In step S40, when it is determined that the timer 564 sends the signal indicating passing the time ($t_6+t_5+t_{4-1}+t_{4-2}$), the CPU 561 sends the signal to the drive signal generation unit 568, so that the drive signal generation unit 568 sends the belt motor drive signal having the signal level of "OFF" to the belt motor control unit 55 to stop the belt motor 24. Further, the CPU 561 sends the signal to the phase signal generation unit 567, so that the phase signal generation unit 567 sends the phase signal to the belt motor control unit 55.

Upon receiving the signal from the CPU 561, the drive signal generation unit 568 sends the belt motor drive signal having the signal level of "OFF" to the belt motor control unit 55. Similarly, upon receiving the signal from the CPU 561, the phase signal generation unit 567 retrieves the second step deceleration information for decelerating the belt motor 24 from the two-level acceleration deceleration table 563*b* in the SRAM 563, and sends the phase signal having a rectangular wave according to the second step deceleration information to the belt motor control unit 55 to decelerate the belt motor 24.

In step S41, the belt 24 gradually decelerates and stops at the time ($t_6+t_5+t_{4-1}+t_{4-2}+t_{4-3}$). Accordingly, the belt 22 gradually slows down from the second constant speed phase at the speed B shown in FIG. 8, becomes the speed zero at the time ($t_6+t_5+t_{4-1}+t_{4-2}+t_{4-3}$).

In step S42, the CPU 561 determines whether the timer 564 sends the signal indicating passing the time ($t_6+t_7$) from the start. When the CPU 561 determines that the timer 564 does not send the signal indicating passing the time ($t_6+t_7$) from the start, the CPU 561 waits until the timer 564 sends the signal indicating passing the time ($t_6+t_7$).

In step S43, when the CPU 561 determines that the timer 564 sends the signal indicating passing the time ($t_6+t_7$) from the start, the CPU 561 determines that the printing operation is completed. Accordingly, the CPU 561 sends the signal to the current setting standard voltage signal generation unit 569, so that the current setting standard voltage signal generation unit 569 stops sending the current setting standard voltage signal. Upon receiving the signal from the CPU 561, the current setting standard voltage signal generation unit 569 stops sending the current setting standard voltage signal, thereby completing the printing operation.

In the embodiment, it is set such that, for example, A=100 mm/s; B=50 mm/s; $t_3$=200 ms; $t_{4-1}$=30 ms; $t_{4-2}$=100 ms; $t_{4-3}$=50 ms; $t_5$=100 ms; $t_6$=5000 ms; and $t_7$ ($=t_5+t_{4-1}+t_{4-2}+t_{4-3}$)=300 ms.

In the embodiment, the belt motor control unit 55 controls the drum motor control units 54 (#A to #D) to decelerate according to the first step deceleration information, the second constant speed information, and the first step deceleration information stored the two-level acceleration deceleration table 563*b* in the SRAM 563. Accordingly, the moving amount of the belt 22 during the deceleration from the speed A to the speed zero through the second constant speed state becomes larger than the moving amount of the photosensitive drums 21*a* (#A to #D) during the deceleration. Accordingly, it is possible to prevent the belt 22 from receiving excessive tension. As a result, it is possible to prevent the toner images from being shifted when the toner images are transferred to the sheet, thereby preventing color shift. Further, the belt motor control unit 55 controls the belt motor 24 to decelerate in the two steps, thereby stably moving the belt 22 without excessive vibration.

Third Embodiment

A third embodiment of the present invention will be explained next. An image forming apparatus in the third embodiment has a configuration similar to that in the first and second embodiments shown in FIGS. 1 to 3. Accordingly, components in the third embodiment similar to those in the first and second embodiments are designated with the same reference numerals, and explanations thereof are omitted.

Similar to the first and second embodiments, in the third embodiment, as shown in FIG. 1, the image forming apparatus includes the sheet supply unit 1 having the sheet storage unit 11 for storing the sheet; the image forming unit 2 having the image supporting members 21 (#A to #D) for forming the static latent image and the belt 22 for transporting the sheet; the fixing unit 3 having the fixing roller 31; the sheet discharge unit 4; and the apparatus control system 5 (not shown in FIG. 1).

Figure 10:
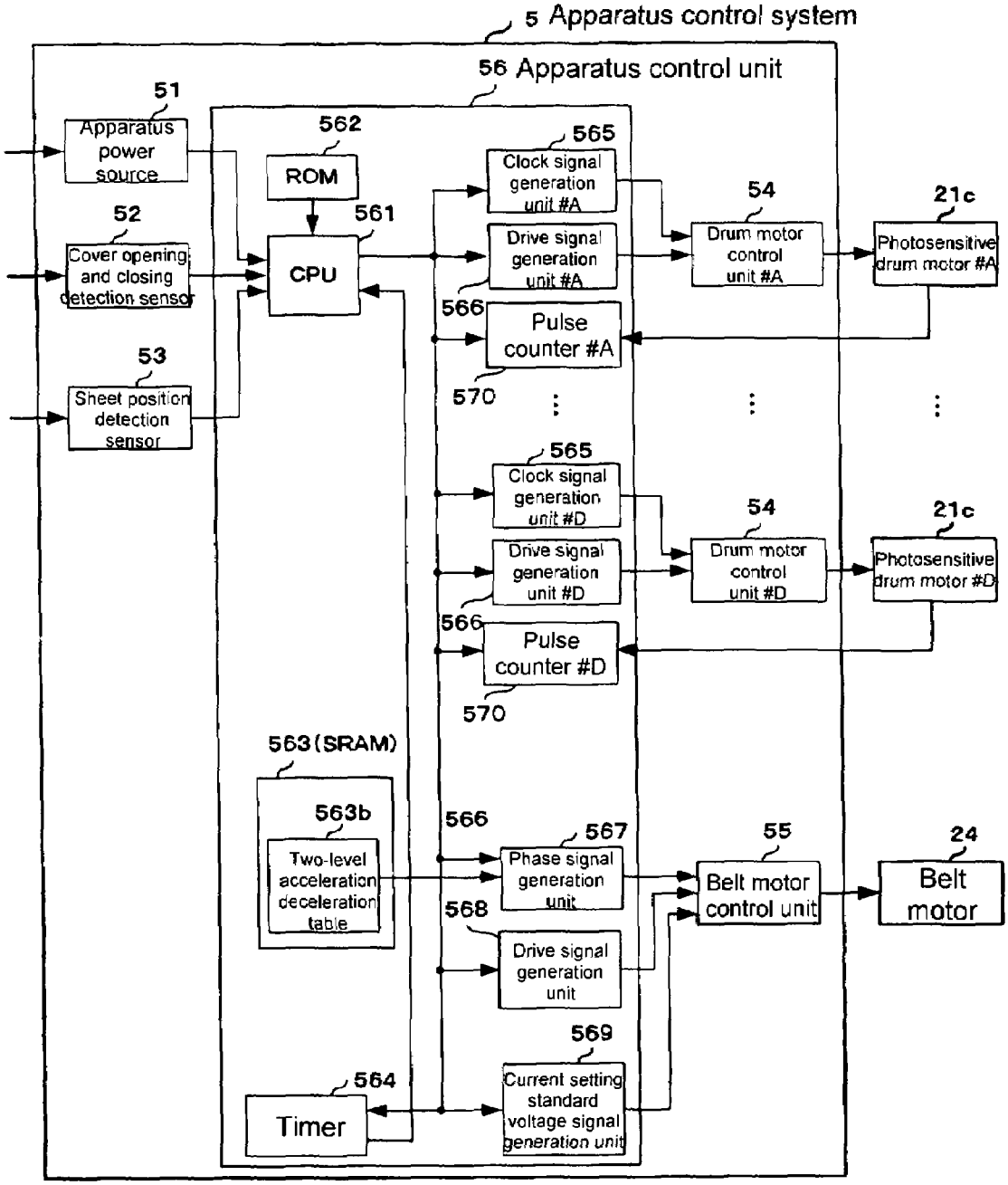
FIG. 10 is a block diagram showing an apparatus control system of an image forming apparatus according to a third embodiment of the present invention.

FIG. 10 is a block diagram showing the apparatus control system 5 of the image forming apparatus according to the third embodiment of the present invention. As shown in FIG. 10, the apparatus control system 5 includes the apparatus power source 51; the cover opening and closing detection sensor 52; the sheet position detection sensor 53; the drum motor control units 54 (#A to #D); the belt motor control unit 55; and the apparatus control unit 56. The apparatus power source 51; the cover opening and closing detection sensor 52; the sheet position detection sensor 53; the drum motor control units 54 (#A to #D); and the belt motor control unit 55 have configurations same as those in the first and second embodiments, and explanations thereof are omitted.

In the embodiment, the apparatus control unit 56 includes the CPU 561; the ROM 562 for storing a control program; the SRAM 563; the timer 564 for measuring a time; the clock signal generation units 565 (#A to #D); the drive signal generation units 566 (#A to #D); the phase signal generation unit 567; the drive signal generation unit 568; the current setting standard voltage signal generation unit 569; and pulse counters 570 (#A to #D). The ROM 562; the SRAM 563; the clock signal generation units 565 (#A to #D); the drive signal generation units 566 (#A to #D); the phase signal generation unit 567; the drive signal generation unit 568; and the current setting standard voltage signal generation unit 569 have configurations same as those in the first embodiment, and explanations thereof are omitted.

In the embodiment, the pulse counters 570 (#A to #D) count and store rotations of the photosensitive drum motors 21*c* (#A to #D). The CPU 561 retrieves the rotations stored in the pulse counters 570 (#A to #D), and calculates a frequency from the rotations (frequency=total input pulse count/specific period of time), so that the frequency is converted to a drum speed A'. Further, the CPU 561 calculates a deceleration time $t_{3-2}$ of the photosensitive drum motors 21*c* (#A to #D) from the following equation:

$$t_{3-2}=\{A/(A-A')\}\times t_{3-1}$$

where $t_{3-1}$ is a specific period of time after the deceleration, and A' is a drum speed after the time $t_{3-1}$ after the deceleration.

In the embodiment, the pulse counters 570 (#A to #D) detect a pulse edge, so that the drum motor rotations of the drum motor control units 54 (#A to #D) are detected. Further, the pulse counters 570 (#A to #D) add one to a counter reading every time the pulse counters 570 (#A to #D) detect an input pulse. After a specific period of time, the CPU 561 retrieves a total number of the input pulses from the pulse counters 570 (#A to #D).

Figure 12:
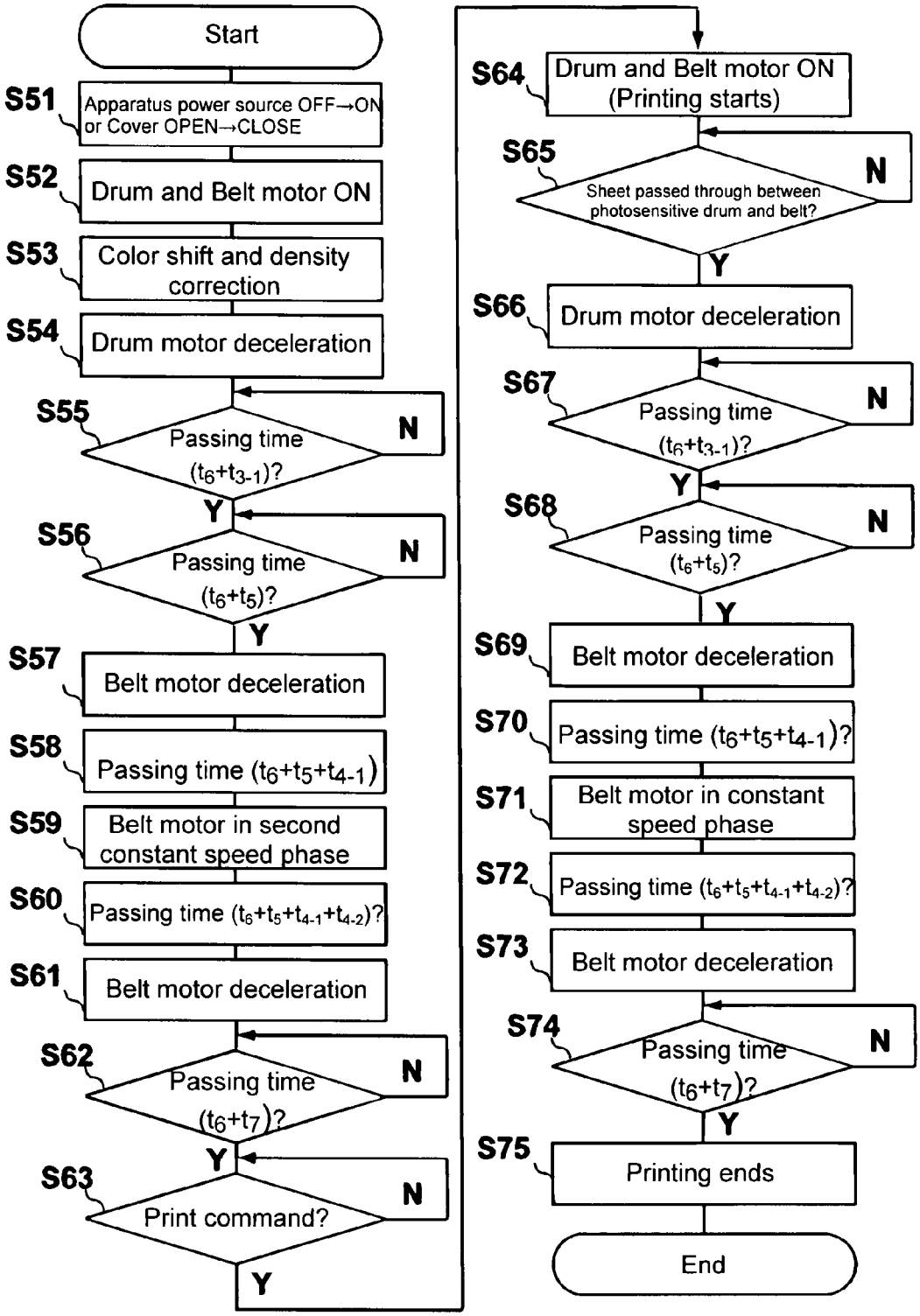
FIG. 12 is a flow chart showing an operation of the image forming apparatus according to the third embodiment of the present invention.

An operation of the image forming apparatus according to the embodiment will be explained next. FIG. 12 is a flow chart showing the operation of the image forming apparatus according to the third embodiment of the present invention.

In the third embodiment, a process from step S51, in which the apparatus power source 51 rectifies and smoothes an AC voltage to obtain a DC voltage to be output to the apparatus control unit 56, to step S53, in which the color shift correction and the density correction are performed, is similar to that from step S21 to step S23 shone in FIG. 9 in the second embodiment.

When the timer 564 sends the signal indicating passing the time $t_6$, the CPU 561 sends the signals to the drive signal generation units 566 (#A to #D), so that the drive signal generation units 566 (#A to #D) send the drum motor drive signals having the signal level of "OFF" to the drum motor control units 54 (#A to #D). Further, the CPU 561 sends the signals to the clock signal generation units 565 (#A to #D), so that the clock signal generation units 565 (#A to #D) stop outputting the clock signals to the drum motor control units 54 (#A to #D). Further, the CPU 561 sends signals to the pulse counters 570 (#A to #D), so that the pulse counters 570 (#A to #D) count the input pulses.

Upon receiving the signals from the CPU 561, the drive signal generation units 566 (#A to #D) send the drum motor drive signals having the signal level of "OFF" to the drum motor control units 54 (#A to #D). Further, upon receiving the signals from the CPU 561, the clock signal generation units 565 (#A to #D) stop outputting the clock signals to the drum motor control units 54 (#A to #D).

Figure 11:
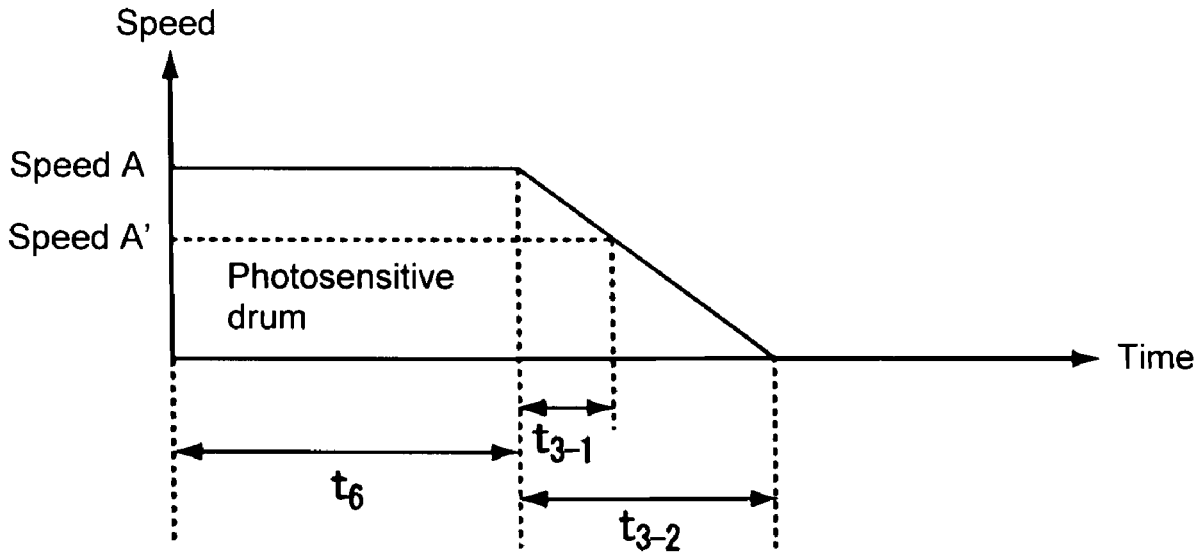
FIG. 11 is a graph showing a relationship between a speed and a time of a photosensitive drum motor according to the third embodiment of the present invention.

In step S54, when the drum motor control units 54 (#A to #D) receive the drum motor drive signals having the signal level of "OFF" from the drive signal generation units 566 (#A to #D), and the clock signal generation units 565 (#A to #D) stop outputting the clock signals to the drum motor control units 54 (#A to #D), the drum motor control units 54 (#A to #D) stop the photosensitive drum motors 21*c* (#A to #D). Accordingly, as shown in FIG. 11, the photosensitive drum motors 21*c* (#A to #D) gradually decelerate.

In step S55, the CPU 561 determines whether the timer 564 sends the signal indicating passing the time ($t_6+t_{3-1}$). When it is determined that the timer 564 does not send the signal indicating passing the time ($t_6+t_{3-1}$), the CPU 561 waits until the timer 564 sends the signal indicating passing the time ($t_6+t_{3-1}$). When it is determined that the timer 564 sends the signal indicating passing the time ($t_6+t_{3-1}$), the CPU 561 retrieves the total number of the input pulses indicating the rotations of the photosensitive drum motors 21*c* (#A to #D) from the pulse counters 570 (#A to #D).

The CPU 561 calculates the frequency from the total number of the input pulses, and converts the frequency to the drum speed A'. Then, the CPU 561 calculates the deceleration time $t_{3-2}$ of the photosensitive drum motors 21*c* (#A to #D) from the following equation:

$$t_{3-2}=\{A/(A-A')\}\times t_{3-1}$$

A process from step S56, in which the CPU 561 determines whether the timer 564 sends the signal indicating passing the time ($t_6+t_5$) from the start, to step S65, in which it is determined whether the sheet passes through the photosensitive drum 21*a* (#A), is similar to the process from step S25 to step S24 in the second embodiment.

When the CPU 561 receives the signal indicating passing the time $t_6$ from the timer 564, the CPU 561 sends the signals to the drive signal generation units 566 (#A to #D), so that the drive signal generation units 566 (#A to #D) send the drum motor drive signals having the signal level of "OFF" to the drum motor control units 54 (#A to #D). Further, the CPU 561 sends the signals to the clock signal generation units 565 (#A to #D), so that the clock signal generation units 565 (#A to #D) stop outputting the clock signals to the drum motor control units 54 (#A to #D).

Upon receiving the signals from the CPU 561, the drive signal generation units 566 (#A to #D) send the drum motor drive signals having the signal level of "OFF" to the drum motor control units 54 (#A to #D). Further, upon receiving the signals from the CPU 561, the clock signal generation units 565 (#A to #D) stop outputting the clock signals to the drum motor control units 54 (#A to #D).

In step S66, when the drum motor control units 54 (#A to #D) receive the drum motor drive signals having the signal level of "OFF" from the drive signal generation units 566 (#A to #D), and the clock signal generation units 565 (#A to #D) stop outputting the clock signals to the drum motor control units 54 (#A to #D), the drum motor control units 54 (#A to #D) stop the photosensitive drum motors 21*c* (#A to #D). Accordingly, as shown in FIG. 11, the photosensitive drum motors 21*c* (#A to #D) gradually decelerate.

In step S67, the CPU 561 determines whether the timer 564 sends the signal indicating passing the time ($t_6+t_{3-1}$). When it is determined that the timer 564 does not send the signal indicating passing the time ($t_6+t_{31}$), the CPU 561 waits until the timer 564 sends the signal indicating passing the time ($t_6+t_{3-1}$). When it is determined that the timer 564 sends the signal indicating passing the time ($t_6+t_{3-1}$), the CPU 561 retrieves the total number of the input pulses indicating the rotations of the photosensitive drum motors 21*c* (#A to #D) from the pulse counters 570 (#A to #D).

The CPU 561 calculates the frequency from the total number of the input pulses, and converts the frequency to the drum speed A'. Then, the CPU 561 calculates the deceleration time $t_{3-2}$ of the photosensitive drum motors 21*c* (#A to #D) from the following equation:

$$t_{3-2}=\{A/(A-A')\}\times t_{3-1}$$

A process from step S68, in which the CPU 561 determines whether the timer 564 sends the signal indicating passing the time ($t_6+t_5$), to step S75, in which the printing operation is completed, is similar to the process from step S36 to step S43 in the first embodiment.

In the embodiment, when it is set such that, for example, $t_{3-1}$=50 ms, A=100 mm/s, and A'=75 mm/s, $t_{3-2}$ becomes 200 ms.

In the third embodiment, it is possible to obtain an effect similar to that in the second embodiment. Further, the CPU 561 determines the deceleration time $t_{3-2}$ of the photosensitive drum motors 21*c* (#A to #D) when the photosensitive drum motors 21*c* (#A to #D) start decelerating according to the total number of the input pulses indicating the rotations of the photosensitive drum motors 21*c* (#A to #D) detected by the pulse counters 570 (#A to #D). Accordingly, it is possible to correct a variance in the deceleration time of the photosensitive drum motors 21*c* (#A to #D), thereby reducing a variance in a stopping position.

Fourth Embodiment

A fourth embodiment of the present invention will be explained next. An image forming apparatus in the fourth embodiment has a configuration similar to that in the first to third embodiments shown in FIGS. 1 to 3. Accordingly, components in the fourth embodiment similar to those in the first to third embodiments are designated with the same reference numerals, and explanations thereof are omitted.

Similar to the first and third embodiments, in the fourth embodiment, as shown in FIG. 1, the image forming apparatus includes the sheet supply unit 1 having the sheet storage unit 11 for storing the sheet; the image forming unit 2 having the image supporting members 21 (#A to #D) for forming the static latent image and the belt 22 for transporting the sheet; the fixing unit 3 having the fixing roller 31; the sheet discharge unit 4; and the apparatus control system 5 (not shown in FIG. 1).

Figure 13:
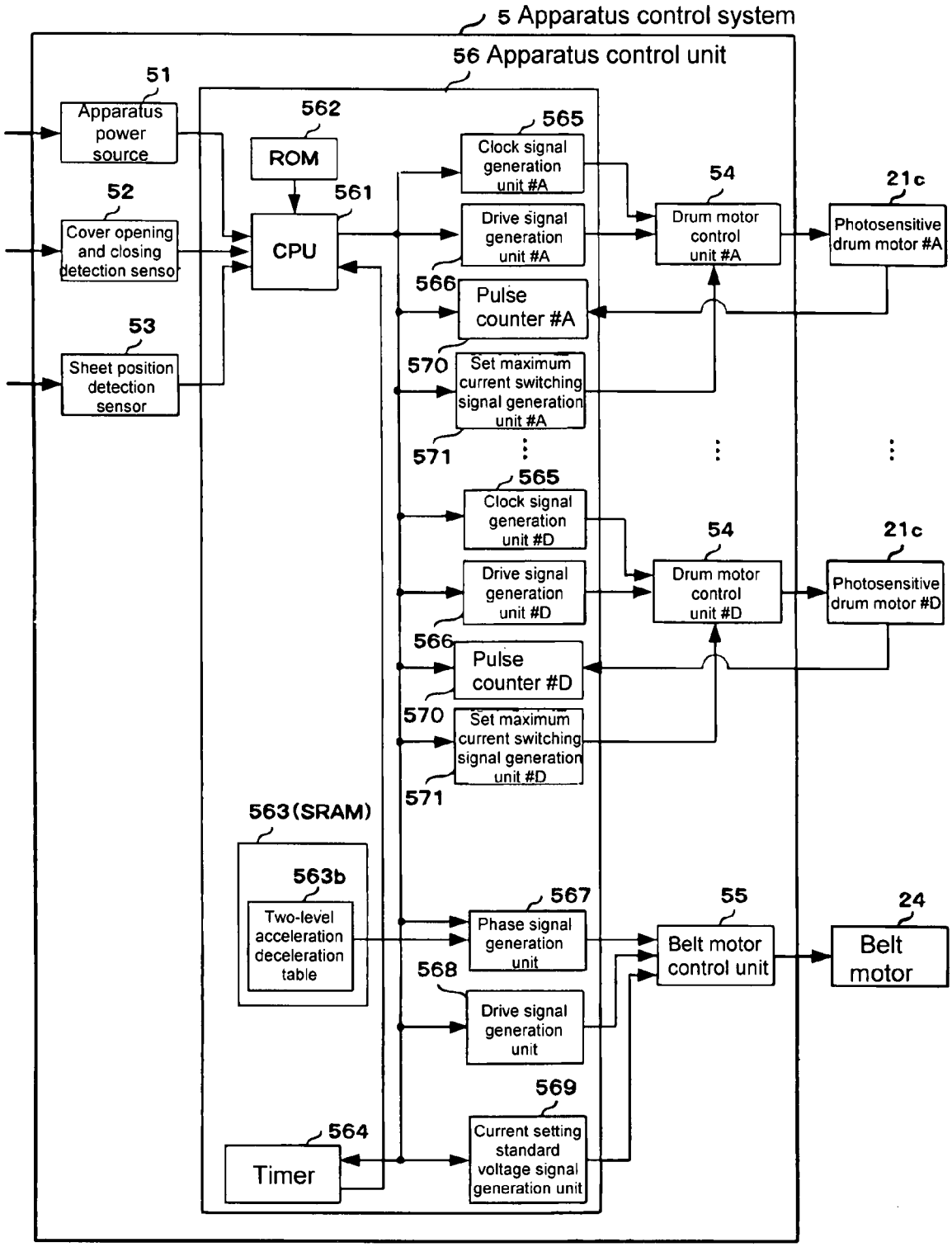
FIG. 13 is a block diagram showing an apparatus control system of an image forming apparatus according to a fourth embodiment of the present invention.

FIG. 13 is a block diagram showing the apparatus control system 5 of the image forming apparatus according to the fourth embodiment of the present invention. As shown in FIG. 13, the apparatus control system 5 includes the apparatus power source 51; the cover opening and closing detection sensor 52; the sheet position detection sensor 53; the drum motor control units 54 (#A to #D); the belt motor control unit 55; and the apparatus control unit 56. The apparatus power source 51; the cover opening and closing detection sensor 52; the sheet position detection sensor 53; the drum motor control units 54 (#A to #D); and the belt motor control unit 55 have configurations same as those in the first and third embodiments, and explanations thereof are omitted.

In the embodiment, the apparatus control unit 56 includes the CPU 561; the ROM 562 for storing a control program; the SRAM 563; the timer 564 for measuring a time; the clock signal generation units 565 (#A to #D); the drive signal generation units 566 (#A to #D); the phase signal generation unit 567; the drive signal generation unit 568; the current setting standard voltage signal generation unit 569; the pulse counters 570 (#A to #D); and set maximum current switching signal generation units 571 (#A to #D). The ROM 562; the SRAM 563; the clock signal generation units 565 (#A to #D); the drive signal generation units 566 (#A to #D); the phase signal generation unit 567; the drive signal generation unit 568; the current setting standard voltage signal generation unit 569; and the pulse counters 570 (#A to #D) have configurations same as those in the third embodiment, and explanations thereof are omitted.

In the embodiment, the set maximum current switching signal generation units 571 (#A to #D) are provided for switching peak current setting of the photosensitive drum motors 21*c* (#A to #D) stored in the drum motor control units 54 (#A to #D).

Figure 14:
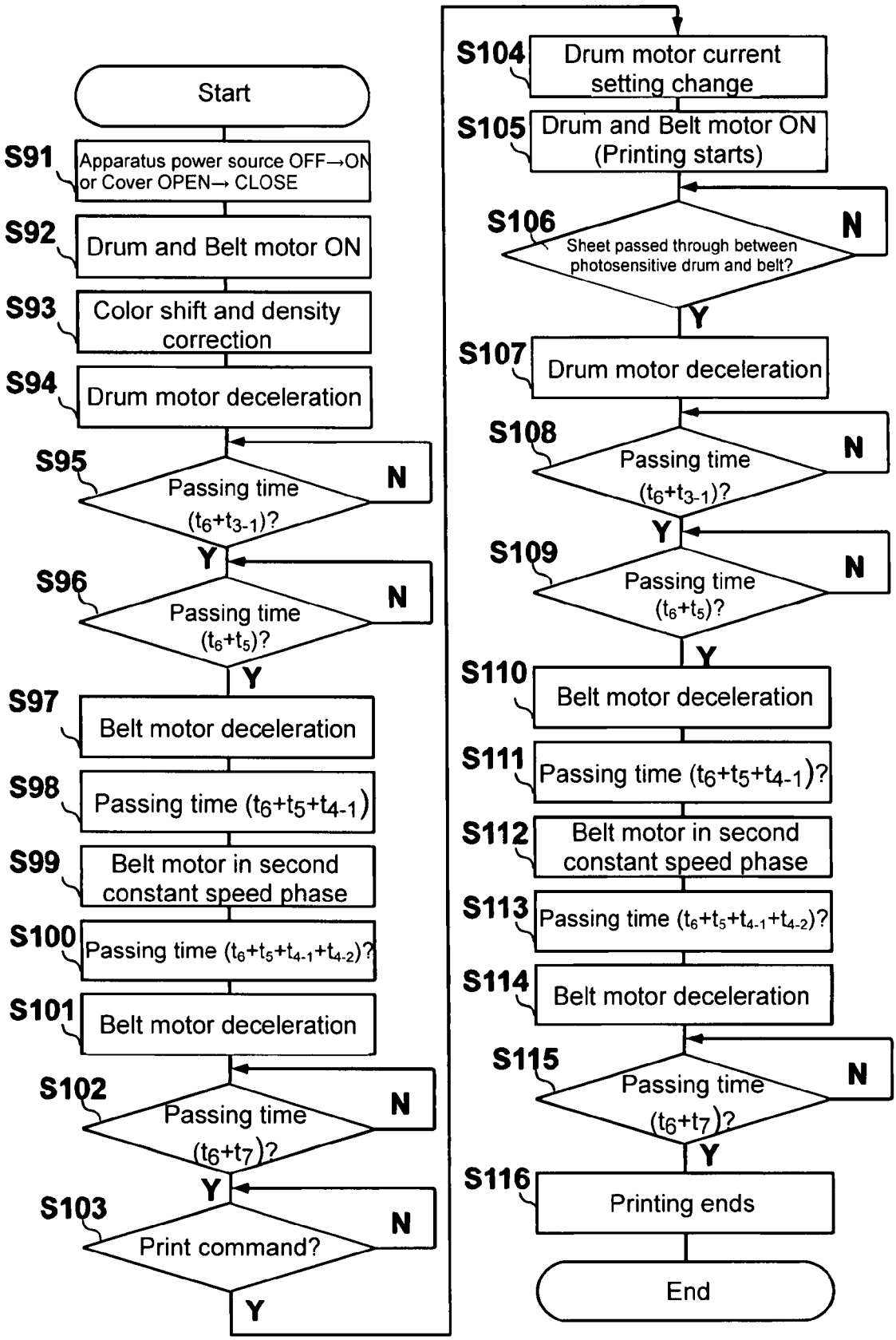
FIG. 14 is a flow chart showing an operation of the image forming apparatus according to the fourth embodiment of the present invention.

An operation of the image forming apparatus according to the embodiment will be explained next. FIG. 14 is a flow chart showing the operation of the image forming apparatus according to the fourth embodiment of the present invention.

In the fourth embodiment, a process from step S91, in which the apparatus power source 51 rectifies and smoothes an AC voltage to obtain a DC voltage to be output to the apparatus control unit 56, to step S95, in which it is determined whether the time $t_{3-1}$ passes, is similar to that from step S51 to step S55 shone in FIG. 11 in the third embodiment.

When it is determined that the timer 564 sends the signal indicating passing the time ($t_6+t_{3-1}$) in step S95, the CPU 561 retrieves the total number of the input pulses indicating the rotations of the photosensitive drum motors 21*c* (#A to #D) from the pulse counters 570 (#A to #D).

The CPU 561 calculates the frequency from the total number of the input pulses, and converts the frequency to the drum speed A'. Then, the CPU 561 calculates the deceleration time $t_{3-2}$ of the photosensitive drum motors 21*c* (#A to #D) from the following equation:

$$t_{3-2}=\{A/(A-A')\}\times t_{3-1}$$

Afterward, the CPU 561 calculates a current I to be output to the photosensitive drum motors 21*c* (#A to #D) from the drum speed A' using the following equation:

$$I=a\times A'+b$$

where a and b are specific constants.

A process from step S96, in which the CPU 561 determines whether the timer 564 sends the signal indicating passing the time ($t_6+t_5$) from the start, to step S103, in which it is determined whether the print command is input, is similar to the process from step S56 to step S63 in the third embodiment.

When the CPU 561 determines that the print command is input in step S103, the CPU 561 sends signals to the set maximum current switching signal generation units 571 (#A to #D), so that the set maximum current switching signal generation units 571 (#A to #D) send set maximum current switching signals. Upon receiving the signals from the CPU 561, the set maximum current switching signal generation units 571 (#A to #D) send the set maximum current switching signals to the drum motor control units 54 (#A to #D) to change drum motor current setting.

In step S104, the drum motor control units 54 (#A to #D) change the drum motor current setting to be output to the photosensitive drum motors 21*c* (#A to #D). A process from step 105 to step 116 is similar to that from step S64 to step S75 in the third embodiment.

In the fourth embodiment, it is possible to obtain an effect similar to that in the third embodiment. Further, according to the deceleration time of the photosensitive drum motors 21*c* (#A to #D), the set maximum current switching signal generation units 571 (#A to #D) send the set maximum current switching signals to the drum motor control units 54 (#A to #D) to change the drum motor current setting, thereby preventing an excessive current from flowing. Accordingly, it is possible to prevent the photosensitive drum motors 21*c* (#A to #D) from rotating for a long period of time when an excessive load is applied to the photosensitive drums 21*a* (#A to #D). As a result, it is possible to prevent an internal gear disposed in the image forming apparatus from breaking, thereby extending life of the image forming apparatus.

In the first to fourth embodiments described above, the present invention is applied to the image forming apparatus, and may be applicable to a multi-function printer (MFP) and a copier.

The disclosure of Japanese Patent Applications No. 2006-261256, filed on Sep. 26, 2006, is incorporated in the application by reference.

While the invention has been explained with reference to the specific embodiments of the invention, the explanation is illustrative and the invention is limited only by the appended claims.

What is claimed is:

1. An image forming apparatus comprising:

an image supporting member disposed to be rotatable;

a belt facing the image supporting member and disposed to be rotatable;

a belt drive unit for rotating the belt;

an acceleration and deceleration information storage unit for storing acceleration and deceleration information to control acceleration and deceleration of the belt; and a belt speed control unit for controlling the belt drive unit to adjust a speed of the belt according to the acceleration and deceleration information stored in the acceleration and deceleration information storage unit, said belt speed control unit determining a difference between a first moving amount corresponding to rotations of the image supporting member from a stationary state thereof to a specific speed and a second moving amount corresponding to rotations of the belt from a stationary state thereof to the specific speed, said belt speed control unit controlling the belt drive unit to start decelerating the belt after the image supporting member starts decelerating and before the image supporting member stops rotating, and controlling the belt drive unit to stop the belt after the image supporting member stops rotating so that a third moving amount corresponding to rotations of the belt from the specific speed to the stationary state thereof becomes larger than a fourth moving amount corresponding to rotations of the image supporting member from the specific speed to the stationary state thereof according to the difference between the first moving amount and the second moving amount.

2. The image forming apparatus according to claim 1, wherein said image supporting member is arranged to rotate at a speed same as that of the belt when the image forming apparatus forms an image.

3. The image forming apparatus according to claim 1, wherein said acceleration and deceleration information storage unit is arranged to store the acceleration and deceleration information for decelerating the belt drive unit in one step, said belt speed control unit controlling the belt drive unit to adjust the speed of the belt according to the acceleration and deceleration information.

4. The image forming apparatus according to claim 1, wherein said acceleration and deceleration information storage unit is arranged to store the acceleration and deceleration information for decelerating the belt drive unit in two steps, said belt speed control unit controlling the belt drive unit to adjust the speed of the belt according to the acceleration and deceleration information.

5. The image forming apparatus according to claim 1, wherein said acceleration and deceleration information storage unit is arranged to store the acceleration and deceleration information including a specific pre-defined time when the belt starts decelerating after the image supporting member starts decelerating, said belt speed control unit controlling the belt drive unit to start decelerating the belt after the specific pre-defined time after the image supporting member starts decelerating according to the acceleration and deceleration information.

6. The image forming apparatus according to claim 1, further comprising:

an image supporting member drive unit for driving the image supporting member:

an image supporting member rotation detection unit for detecting a rotational speed of the image supporting member;

a deceleration time determining unit for determining a deceleration start time when the rotational speed detected by the image supporting member rotation detection unit starts decelerating, and for determining from the deceleration start time a deceleration time necessary for the image supporting member drive unit to decelerate; and an image supporting member speed control unit for controlling the image supporting member drive unit to decelerate the image supporting member in the deceleration time determined by the deceleration time determining unit.

7. The image forming apparatus according to claim 6, further comprising a current setting signal generation unit for sending a setting signal to the image supporting member speed control unit so that the image supporting member speed control unit sets a current to be supplied to the image supporting member drive unit according to the deceleration time determined by the deceleration time determining unit.

8. The image forming apparatus according to claim 1, further comprising a drive signal generation unit for sending a signal to the belt speed control unit to start or stop the belt drive unit, and a phase signal generation unit for sending a phase signal to the belt speed control unit according to the acceleration and deceleration information.

9. The image forming apparatus according to claim 1, further comprising a motor for driving the image supporting member, a motor control unit for controlling the motor, and a drive signal generation unit for sending a signal to the motor control unit to start or stop the motor.

10. The image forming apparatus according to claim 1, wherein said belt speed control unit is adapted to control the belt drive unit to decelerate the belt at a rate greater than that of the image supporting member.

11. The image forming apparatus according to claim 1, wherein said belt speed control unit is adapted to control the belt drive unit to accelerate the belt at a rate smaller than that of the image supporting member.

12. The image forming apparatus according to claim 1, wherein said belt speed control unit is adapted to control the belt drive unit to accelerate the belt at an acceleration rate smaller than that of the image supporting member and decelerate the belt at a deceleration rate greater than the acceleration rate.

13. The image forming apparatus according to claim 1, wherein said image supporting member is adapted to accelerate at an acceleration rate greater a deceleration rate of the image supporting member.

14. The image forming apparatus according to claim 1, wherein said belt speed control unit is adapted to control the belt drive unit to start driving the belt at the same time when the image supporting member start being driven, said belt speed control unit controlling the belt drive unit to drive the belt to reach a constant speed within a period of time greater than that within which the image supporting member reaches a constant speed.

15. The image forming apparatus according to claim 14, wherein said belt speed control unit is adapted to control the belt drive unit to start decelerating the belt at a timing different from a timing of decelerating the image supporting member by a difference according to a difference between an acceleration time of the motor and an acceleration time of the belt drive unit and a difference between a deceleration time of the motor and a deceleration time of the belt drive unit.

16. The image forming apparatus according to claim 15, wherein said belt speed control unit is adapted to control the belt drive unit to start decelerating the belt at the timing t5 expressed by the following equation:

$$t5=(t2-t1)/2+(t3-t4)/2+t8$$

where t1 is the acceleration time of the motor, t2 is the acceleration time of the belt drive unit, t3 is the deceleration time of the motor, t4 is the deceleration time of the belt drive unit, and t8 is a drive transmission delay time due to a play and deformation of a gear.

17. The image forming apparatus according to claim 1, wherein said image supporting member includes a photosensitive drum.

* * * * *